US012628862B2

(12) United States Patent
Biasioli et al.

(10) Patent No.: US 12,628,862 B2
(45) Date of Patent: May 19, 2026

(54) LIQUID TOBACCO EXTRACT, METHOD FOR MAKING AND AEROSOL-GENERATING ARTICLES COMPRISING SUCH

(71) Applicant: Philip Morris Products S.A., Neuchatel (CH)

(72) Inventors: Matteo Biasioli, Neuchatel (CH); Marie Farine, Neuchatel (CH); Felix Frauendorfer, Neuchatel (CH); Jagoda Kuc, Neuchatel (CH); Sebastien Lanaspeze, Neuchatel (CH); Stefan Lauenstein, Neuchatel (CH); Benoit Mivelaz, Neuchatel (CH); Christel Raphoz, Neuchatel (CH); Patrick Charles Silvestrini, Neuchatel (CH); Steve Tzimoulis, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 562 days.

(21) Appl. No.: 17/615,686

(22) PCT Filed: Jun. 5, 2020

(86) PCT No.: PCT/EP2020/065710

§ 371 (c)(1),
(2) Date: Dec. 1, 2021

(87) PCT Pub. No.: WO2020/245414

PCT Pub. Date: Dec. 10, 2020

(65) Prior Publication Data

US 2022/0240563 A1 Aug. 4, 2022

(30) Foreign Application Priority Data

Jun. 5, 2019 (EP) ..... 19178548

(51) Int. Cl.
*A24B 15/167* (2020.01)
*A24B 15/24* (2006.01)

(52) U.S. Cl.
CPC ..... *A24B 15/243* (2013.01); *A24B 15/167* (2016.11)

(58) Field of Classification Search
CPC ..... A24B 15/243; A24B 15/167; A24B 7/00; A24B 15/26
See application file for complete search history.

(56) References Cited

U.S. PATENT DOCUMENTS

| | | | | |
|---|---|---|---|---|
| 4,150,677 | A | 4/1979 | Osborne, Jr. et al. | |
| 5,016,654 | A | 5/1991 | Bernasek et al. | |
| 5,038,802 | A | 8/1991 | White et al. | |
| 5,235,992 | A | 8/1993 | Sensabaugh, Jr. | |
| 5,246,017 | A * | 9/1993 | Saintsing et al. | A24D 3/02 131/335 |
| 9,408,417 | B2 | 8/2016 | O'Connell | |
| 10,039,311 | B2 | 8/2018 | Muehlbauer et al. | |
| 2008/0092912 | A1* | 4/2008 | Robinson et al. | A24D 1/00 131/200 |
| 2011/0174323 | A1 | 7/2011 | Coleman, III et al. | |
| 2012/0060854 | A1* | 3/2012 | Chen et al. | A24B 15/24 131/297 |
| 2012/0145170 | A1 | 6/2012 | O'Connell | |
| 2013/0014771 | A1 | 1/2013 | Coleman, III et al. | |
| 2013/0160777 | A1 | 6/2013 | Murphy | |
| 2014/0000636 | A1 | 1/2014 | O'Connell | |
| 2014/0000637 | A1 | 1/2014 | O'Connell | |
| 2014/0271951 | A1* | 9/2014 | Mua et al. | A24B 15/241 131/297 |
| 2016/0106144 | A1 | 4/2016 | Muehlbauer et al. | |
| 2016/0345621 | A1 | 12/2016 | Li et al. | |
| 2016/0360780 | A1 | 12/2016 | Fujisawa et al. | |
| 2017/0273347 | A1* | 9/2017 | Klipfel et al. | A24B 3/14 |
| 2018/0360101 | A1 | 12/2018 | Buehler et al. | |
| 2020/0187551 | A1 | 6/2020 | Pontes et al. | |

FOREIGN PATENT DOCUMENTS

| | | | |
|---|---|---|---|
| CA | 2 940 680 | A1 | 9/2015 |
| CN | 105455190 | A | 4/2016 |
| EP | 0 821 886 | A2 | 2/1998 |
| EP | 3 111 784 | A1 | 1/2017 |
| RU | 2 647 253 | C1 | 3/2018 |
| WO | WO 2015/129679 | A1 | 9/2015 |
| WO | WO 2017/144705 | A1 | 8/2017 |
| WO | WO 2018/019543 | A1 | 2/2018 |
| WO | WO 2018/197879 | A1 | 11/2018 |
| WO | WO 2018/210681 | A2 | 11/2018 |
| WO | WO 2019/026201 | A1 | 2/2019 |

OTHER PUBLICATIONS

Combined Russian Office Action and Search Report issued Nov. 3, 2023 in Russian Patent Application No. 2021135528/03 (with English Translation), 14 pages.
International Search Report and Written Opinion issued on Aug. 28, 2020 in PCT/EP2020/065710 filed Jun. 5, 2020, 11 pages.
Combined Chinese Office Action and Search Report issued on Sep. 27, 2022 in Chinese Patent Application No. 202080034524.6 (with English translation), 18 pages.
Extended European Search Report issued Nov. 27, 2019 in European Patent Application No. 19178548.4, 9 pages.
Japanese Office Action issued Jun. 6, 2023 in Japanese Application 2021-568742, (with English translation), 9 pages.
Indian Office Action issued Aug. 24, 2023 in Indian Patent Application No. 202117032265, 5 pages.
Malaysian Notice of Allowance issued Dec. 17, 2024 in corresponding Malaysian Patent Application No. PI2021004204, filed Jun. 5, 2020.

* cited by examiner

*Primary Examiner* — Michael H. Wilson
*Assistant Examiner* — Ronnie Kirby Jordan
(74) *Attorney, Agent, or Firm* — Oblon, McClelland, Maier & Neustadt, L.L.P.

(57) ABSTRACT

A liquid tobacco extract is provided, including: a non-aqueous solvent; at least 0.2 percent by weight of nicotine based on a weight of the liquid tobacco extract; and a ratio by weight of (β-ionone+β-damascenone) to (phenol) of greater than 0.25.

21 Claims, No Drawings

LIQUID TOBACCO EXTRACT, METHOD FOR MAKING AND AEROSOL-GENERATING ARTICLES COMPRISING SUCH

The invention relates to liquid tobacco extracts.

Aerosol-generating systems for delivering an aerosol to a user that comprise an atomiser configured to generate an inhalable aerosol from a liquid composition, such as a liquid nicotine composition, are known. Some known aerosol-generating systems comprise a thermal atomiser such as an electric heater that is configured to heat and vaporise the liquid composition to generate an aerosol. One popular type of electrically heated aerosol-generating system is an e-cigarette. Other known aerosol-generating systems comprise a non-thermal atomiser that is configured to generate an aerosol from the liquid composition using, for example, impinging jet, ultrasonic or vibrating mesh technologies.

Liquid tobacco extracts can be produced by an extraction process in which nicotine and other volatile flavour compounds are extracted from tobacco material and collected in a suitable solvent.

Methods for producing liquid tobacco extracts from tobacco material are known.

Liquid tobacco extracts may be produced by a high temperature extraction process in which nicotine and other volatile flavour compounds are extracted from tobacco material and collected in a suitable solvent to form a natural liquid tobacco extract.

By way of example, processes are known, wherein a tobacco material is substantially boiled in water for a period of hours or even days to form a vapour phase, and a distillate obtained by condensation of the vapour phase is collected in a vessel. Over time, an oily, waxy layer containing a high proportion of apolar compounds builds up at the surface of the distillate.

The aqueous portion, which the waxy layer builds upon, and which contains nicotine and other water-soluble compounds, is recycled to the boiler. An apolar co-solvent may optionally be fed into the boiler with the aqueous portion in order to increase the extraction yield. On the other hand, the waxy phase is collected and ultimately forms the primary product of one such hydrodistillation process. Such product is often referred to as "tobacco essential oil", and contains a high proportion of apolar compounds found in tobacco, such as fatty acids, neophytadiene, etc. The tobacco essential oil obtained by one such method typically contains no nicotine.

It is also known to subject tobacco material to an extraction process involving use of a volatile apolar solvent. Examples of suitable solvents are cyclic or acyclic short alkanes, as well as chlorinated solvents like dichloromethane. In one such process, the excess solvent may be evaporated by controlled heating under vacuum. Typically, this is done in the presence of ethanol, which has a higher boiling point than the extraction solvent, such that even traces of the extraction solvent can be detected.

The primary product of one such solvent-aided extraction process is often referred to as "tobacco absolute", and may contain traces of ethanol. It is a waxy product and contains a highly concentrated mixture of most of the apolar compounds that can be extracted with the specific solvent, generally including nicotine, which is generally present at relatively high concentrations.

An alternative extraction process involves contacting a tobacco material with a solvent under supercritical conditions, such as supercritical carbon dioxide. One such process is disclosed in US 2013/160777, and relies on the principle that volatile substances within a feed material contacted with a supercritical fluid may partition into the supercritical phase. After dissolution of any soluble material, the supercritical fluid containing the dissolved substances can be removed, and the dissolved components of the feed matter can be separated out from the supercritical fluid. The primary product of a supercritical extraction process is substantially similar to the "tobacco absolute" of a solvent-aided extraction process run at lower temperature and pressure, contains no residual solvent and typically has a high level of the waxy, apolar compounds and includes nicotine, which is generally present at relatively high concentrations.

In another type of extraction process, tobacco material is soaked in a suitable solvent, such as an aerosol former, at room temperature or below, for a period of several weeks in order to extract the tobacco constituents into the solvent. In one such process, often referred to as cold maceration process, a tobacco material is kept in suspension in an extraction liquid for a period of up to several weeks or even months. The resulting slurry is subsequently filtered, and the liquid phase thus collected can be used to manufacture a liquid composition for use in an aerosol-generating system. In one such process, however, it is generally difficult to control the extraction conditions (e.g. temperature and pressure). Further, the liquid phase collected upon filtration of the slurry, which represents the primary product of a cold maceration process, is highly diluted and tends to have a low level of apolar tobacco flavour species. Additionally, the liquid phase typically contains little to no nicotine. As such, liquid extracts obtained by a cold maceration method generally need to be supplemented with additional ingredients, such as nicotine salts and glycerin, before being used in an aerosol-generating system.

Liquid tobacco extracts obtained by such known extraction processes may have a low level of nicotine. Further, liquid tobacco extracts obtained by such extraction processes may have a low level and low variety of flavour species, particularly as regards compounds associated with the flavour of heated tobacco, such as furaneol. Liquid tobacco extracts obtained by such extraction processes may also have a high level of undesirable compounds. In general, the concentration of nicotine, flavour species and undesirable compounds obtained by such extraction processes may be significantly impacted by the type or types of tobacco used as a starting material.

A purpose of the invention is to alleviate one or more of the drawbacks of the liquid tobacco extracts obtained by known processes. It would be particularly desirable to produce novel and improved liquid tobacco extracts.

The present disclosure relates to a liquid tobacco extract. The liquid tobacco extract preferably comprises a non-aqueous solvent. The liquid tobacco extract preferably comprises at least 0.2% by weight of nicotine. The liquid tobacco extract preferably comprises a ratio by weight of (β-ionone+β-damascenone) to (phenol) of greater than 0.25.

The present disclosure further relates to a cartridge comprising a nicotine composition, wherein the nicotine composition comprises the liquid tobacco extract. The present disclosure also relates to a liquid tobacco extract prepared by a method comprising a step of heating a tobacco starting material at an extraction temperature of between 100 degrees Celsius and 160 degrees Celsius for at least 90 minutes.

According to the present invention there is provided a liquid tobacco extract comprising a non-aqueous solvent, at least 0.2 percent by weight of nicotine based on the weight of the liquid tobacco extract, and a ratio by weight of (β-ionone+β-damascenone) to (phenol) of greater than 0.25.

The liquid tobacco extract comprising a non-aqueous solvent, nicotine, and a ratio by weight of (β-ionone+β-damascenone) to (phenol) of greater than 0.25, may be prepared by a method comprising the steps of: heating a tobacco starting material at an extraction temperature of between 100 degrees Celsius and 160 degrees Celsius for at least 90 minutes; collecting the volatile compounds released from the tobacco starting material during the heating step; and forming a liquid tobacco extract comprising the collected volatile compounds.

The inventors have found that, in contrast to the products of existing extraction processes that have been discussed above, liquid tobacco extracts in accordance with the present invention have a significantly higher content of compounds associated with the flavour of heated tobacco. These compounds are substantially absent, or are present in trace amounts, in a tobacco extract obtained by a maceration process, which also typically contains little to no nicotine. These compounds are also generally absent or present in trace amounts in a tobacco extract obtained using a solvent, including under supercritical conditions. Similarly, a tobacco essential oil obtained by way of a distillation process also typically has a very low content—if any—of such compounds associated with the flavour of heated tobacco. The liquid tobacco extract may be produced from a tobacco starting material consisting of a single type of natural tobacco. The tobacco starting material may comprise a blend of two or more types of natural tobaccos. Alternatively, the liquid tobacco extract may be produced from a blend produced from a first tobacco starting material consisting of a first single type of natural tobacco that is extracted to form a first extract, a second tobacco starting material consisting of a second single type of natural tobacco that is extracted to form a second extract, wherein the first extract and second extract are blended to form the liquid tobacco extract. Two or more extracts may be blended in this manner to form the liquid tobacco extract. The ratio of the different tobacco types may be adapted depending on the desired characteristics of the aerosol. For example, where it is desired to provide a relatively high level of nicotine, the proportion of Burley tobacco may be increased.

The liquid tobacco extract may comprise non-aqueous solvent, water, nicotine and flavourant compounds. The liquid tobacco extract may be advantageously used directly to provide a nicotine composition for use in an e-cigarette or other aerosol-generating system. The liquid tobacco extract resulting from an extraction process may be used to provide a nicotine composition without the addition of additional nicotine. The liquid tobacco extract resulting from an extraction process may be used to provide a nicotine composition without the addition of additional flavour compounds. The liquid tobacco extract resulting from an extraction process may be used to provide a nicotine composition without the addition of additional non-aqueous solvent. The liquid tobacco extract resulting from an extraction process may be used to provide a nicotine composition without the addition of additional water.

For example, the liquid tobacco extract produced by the extraction process may be used to make a nicotine composition comprising between 10 and 20 mg of nicotine per millilitre, without the need for addition of nicotine. The term "liquid tobacco extract" describes the direct product of an extraction process from a tobacco material. Thus, the liquid tobacco extract typically includes a mixture of natural components separated from, removed from, or derived from, a natural tobacco material using tobacco extraction processing conditions and techniques. Thus, in one such process extracted tobacco components are removed from the natural tobacco material and separated from unextracted tobacco components. The liquid tobacco extract therefore consists of the mixture of natural tobacco components that have derived from the tobacco starting material and have been extracted or formed during the extraction process, typically in combination with one or more materials other than the tobacco starting material, such as an extraction solvent used during the extraction process. The extraction solvent is preferably an aerosol former.

As used herein, the term "aerosol former" refers to a compound or mixture of compounds that, in use, facilitates formation of an aerosol, and that preferably is substantially resistant to thermal degradation at the operating temperature of the aerosol-generating article or device. Examples of suitable aerosol-formers include: polyhydric alcohols, such as propylene glycol, triethylene glycol, 1,3-propanediol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The liquid tobacco extract may have a nicotine content of at least 0.2 percent by weight. More preferably, the nicotine content in the liquid tobacco extract is at least about 0.4 percent by weight. The liquid tobacco extract may have a nicotine content of no more than about 10 percent by weight, more preferably no more than about 8 percent by weight, more preferably no more than about 5 percent by weight, most preferably no more than about 3.6 percent by weight. Most preferably, the liquid tobacco extract comprises between about 0.4 percent by weight and 3.6 percent by weight nicotine, based on the weight of the liquid tobacco extract.

The skilled reader will understand that herein when a percentage by weight of a particular component is disclosed with reference to a liquid tobacco extract, a concentrated tobacco extract, or a nicotine composition, the percentage by weight is based on the weight of the particular component relative to the total weight of the respective liquid tobacco extract, concentrated tobacco extract or nicotine composition.

The liquid tobacco extract may have a non-aqueous extraction solvent content of from about 25 percent to about 65 percent by weight, preferably from about 30 percent to 60 percent by weight, most preferably from about 35 percent to about 55 percent by weight. The non-aqueous extraction solvent is preferably triacetin, glycerine, propylene glycol, 1,3-propanediol or a mixture thereof.

The liquid tobacco extract may comprise a total content of propylene glycol from about 25 percent to about 65 percent by weight, preferably from about 30 percent to 60 percent by weight, most preferably from about 35 percent to about 55 percent by weight.

The liquid tobacco extract may comprise a total content of triacetin from about 25 percent to about 65 percent by weight, preferably from about 30 percent to 60 percent by weight, most preferably from about 35 percent to about 55 percent by weight.

The liquid tobacco extract may comprise a total content of glycerine from about 25 percent to about 65 percent by weight, preferably from about 30 percent to 60 percent by weight, most preferably from about 35 percent to about 55 percent by weight.

The liquid tobacco extract may comprise a total content of 1,3-propanediol from about 25 percent to about 65 percent by weight, preferably from about 30 percent to 60 percent by weight, most preferably from about 35 percent to about 55 percent by weight.

The extraction method provides a liquid tobacco extract that comprises greater than about percent by weight of water based on the weight of the liquid tobacco extract. Generally, the liquid tobacco extract may comprise at least about 40 percent by weight of water. The liquid tobacco extract may comprise between about 40 percent by weight and about 70 percent by weight water.

The liquid tobacco extract is preferably produced using an extraction method with an extraction temperature within a specific range in combination with a specifically defined heating duration that advantageously provides an improved liquid tobacco extract having a significantly improved balance of desirable compounds to undesirable compounds. In particular, the extraction method provides a liquid tobacco extract having a maximised ratio of desirable compounds to undesirable compounds for the tobacco starting material. For example, the use of the specific combination of extraction temperature and time as defined enables the levels of nicotine and flavourant compounds to be optimised whilst also minimising the levels of undesirable compounds such as furans, phenol and phenolic compounds, and tobacco-specific nitrosamines (TSNAs).

Thus, liquid tobacco extracts obtained by one such method present significant compositional differences with respect to tobacco extracts obtained by the existing extraction processes, and can be used as an e-liquid or for the preparation of an e-liquid that, when heated, generates an aerosol having a distinct composition and flavour characteristics compared with currently available e-liquids. In particular, tobacco extracts obtained by a method in accordance with the invention may be used to generate an aerosol that provides a heated tobacco taste which more closely resembles an aerosol generated by conventional cigarettes or upon heating tobacco in a heat-not-burn device relative to available aerosols produced from existing liquid nicotine compositions.

The liquid tobacco extract is analysed by gas chromatography to determine the content of the liquid. The weight of each compound within the liquid tobacco extract may be reported as micrograms per gram of liquid tobacco extract. Ratios by weight of compounds within the liquid tobacco extract, as described herein, may then be calculated.

In the liquid tobacco extract of the present invention, the ratio by weight of (β-ionone+β-damascenone) to (phenol) is greater than 0.25. The above ratio is higher when the amount of desirable flavourant compounds β-ionone and β-damascenone is higher, or when the amount of phenol is lower.

Preferably, the first ratio by weight of (β-ionone+β-damascenone) to (phenol) is greater than 0.5, more preferably greater than 1, even more preferably greater than 1.5, most preferably greater than 2, for example between 2 and 10 or between 2 and 5.

The liquid tobacco extract of the present invention may comprise a ratio by weight of (β-ionone+β-damascenone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600)) of greater than 1.5.

The above ratio is higher when the amount of desirable flavourant compounds β-ionone and β-damascenone is higher, or when the amount of TSNAs and 2-furanemethanol is lower. The ratio by weight of (β-ionone+β-damascenone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600)) may be more than 0.2, such as more than 0.5, such as between about 1 and about 10 or between about 1.5 and about 6. Preferably, the ratio by weight is between about 2 and about 4.

The liquid tobacco extract may comprise other desirable compounds derived directly from natural tobacco, many of which are flavourants. The liquid tobacco extract may comprise one or more of furaneol, 2,3-diethyl-5-methylpyrazine, acetic acid, vanillin, 2-ethyl-3,5-dimethylpyrazine, 2-methylbutanoic acid, 3-methylbutanoic acid, 3-methyl-2,4-nonanedione, 2-methoxyphenol, 2-phenylethanol, eugenol and sotolone.

The liquid tobacco extract comprises β-ionone. The liquid tobacco extract may comprise at least 0.100 micrograms β-ionone per gram of the liquid tobacco extract, preferably at least 0.200 micrograms β-ionone per gram of the liquid tobacco extract, more preferably at least 0.300 micrograms β-ionone per gram of the liquid tobacco extract, most preferably at least 0.400 micrograms β-ionone per gram of the liquid tobacco extract. In preferred embodiments, the liquid tobacco extract comprises at least 0.500 micrograms β-ionone per gram of the liquid tobacco extract, more preferably at least 0.600 micrograms β-ionone per gram of the liquid tobacco extract, even more preferably at least 0.700 micrograms β-ionone per gram of the liquid tobacco extract, most preferably at least 0.800 micrograms β-ionone per gram of the liquid tobacco extract. In particularly preferred embodiments, the liquid tobacco extract comprises at least 0.9 micrograms β-ionone per gram of the liquid tobacco extract, preferably at least 1.00 micrograms β-ionone per gram of the liquid tobacco extract, more preferably at least 1.10 micrograms β-ionone per gram of the liquid tobacco extract, even more preferably at least 1.20 micrograms β-ionone per gram of the liquid tobacco extract, most preferably at least 1.30 micrograms β-ionone per gram of the liquid tobacco extract. The ratio by weight of (β-ionone) to (phenol) may be greater than 0.150, for example greater than 0.200, preferably greater than 0.400, more preferably greater than 0.600, most preferably greater than 0.800, such as greater than 1.20. The ratio by weight of (β-ionone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.300, for example greater than 0.500, preferably greater than 0.750, more preferably greater than 1.00, most preferably greater than 1.20, such as greater than 1.80.

The liquid tobacco extract comprises β-damascenone. The liquid tobacco extract may comprise at least 0.100 micrograms β-damascenone per gram of the liquid tobacco extract, preferably at least 0.350 micrograms β-damascenone per gram of the liquid tobacco extract, more preferably at least 0.600 micrograms β-damascenone per gram of the liquid tobacco extract, most preferably at least 0.850 micrograms β-damascenone per gram of the liquid tobacco extract. In preferred embodiments, the liquid tobacco extract comprises at least 1.10 micrograms β-damascenone per gram of the liquid tobacco extract, more preferably at least 1.35 micrograms β-damascenone per gram of the liquid tobacco extract, even more preferably at least 1.60 micrograms β-damascenone per gram of the liquid tobacco extract, most preferably at least 1.85 micrograms β-damascenone per gram of the liquid tobacco extract. In particularly preferred embodiments, the liquid tobacco extract comprises at least 2.10 micrograms β-damascenone per gram of the liquid tobacco extract, preferably at least 2.35 micrograms β-damascenone per gram of the liquid tobacco extract, more preferably at least 2.60 micrograms β-damascenone per gram of the liquid tobacco extract, even more preferably at least 2.75 micrograms β-damascenone per gram of the liquid tobacco extract, most preferably at least 2.90 micrograms β-damascenone per gram of the liquid tobacco extract. The ratio by weight of (β-damascenone) to (phenol) may be greater than 0.250, for example greater than 0.300, preferably greater than 0.700, more preferably greater than 1.00, most preferably greater than 1.30, such as greater than 1.60. The ratio by weight of (β-damascenone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.300, for example greater than 0.700, preferably greater than 1.00, more preferably greater than 1.50, most preferably greater than 2.20, such as greater than 2.70.

The ratio by weight of (β-ionone+β-damascenone) to (nicotine) may be greater than $5.00\times10^{-5}$, for example greater than $1.00\times10^{-4}$, preferably greater than $2.00\times10^{-4}$, more preferably greater than $4.00\times10^{-4}$, most preferably greater than $6.00\times10^{-4}$, such as greater than $7.00\times10^{-4}$.

The liquid tobacco extract may comprise furaneol. The liquid tobacco extract may comprise at least 0.0100 micrograms furaneol per gram of the liquid tobacco extract, preferably at least 0.100 micrograms furaneol per gram of the liquid tobacco extract, more preferably at least 0.300 micrograms furaneol per gram of the liquid tobacco extract, most preferably at least 0.500 micrograms furaneol per gram of the liquid tobacco extract. In preferred embodiments, the liquid tobacco extract comprises at least 0.700 micrograms furaneol per gram of the liquid tobacco extract, more preferably at least 0.900 micrograms furaneol per gram of the liquid tobacco extract, even more preferably at least 1.10 micrograms furaneol per gram of the liquid tobacco extract, most preferably at least 1.30 micrograms furaneol per gram of the liquid tobacco extract. In particularly preferred embodiments, the liquid tobacco extract comprises at least 1.50 micrograms furaneol per gram of the liquid tobacco extract, preferably at least 1.80 micrograms furaneol per gram of the liquid tobacco extract, more preferably at least 2.00 micrograms furaneol per gram of the liquid tobacco extract, even more preferably at least 2.20 micrograms furaneol per gram of the liquid tobacco extract, most preferably at least 2.40 micrograms furaneol per gram of the liquid tobacco extract. The ratio by weight of (furaneol) to (phenol) may be greater than 0.400, for example greater than 0.600, preferably greater than 0.800, more preferably greater than 1.00, most preferably greater than 1.10, such as greater than 1.30. The ratio by weight of (furaneol) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.600, for example greater than 0.800, preferably greater than 1.00, more preferably greater than 1.50, most preferably greater than 2.00, such as greater than 2.10.

The liquid tobacco extract may comprise 2,3-diethyl-5-methylpyrazine. The liquid tobacco extract may comprise at least $3.00\times10^{-3}$ micrograms 2,3-diethyl-5-methylpyrazine per gram of the liquid tobacco extract, preferably at least $5.00\times10^{-3}$ micrograms 2,3-diethyl-5-methylpyrazine per gram of the liquid tobacco extract, more preferably at least $9.00\times10^{-3}$ micrograms 2,3-diethyl-5-methylpyrazine per gram of the liquid tobacco extract, most preferably at least $1.50\times10^{-2}$ micrograms 2,3-diethyl-5-methylpyrazine per gram of the liquid tobacco extract. In preferred embodiments, the liquid tobacco extract comprises at least $2.50\times10^{-2}$ micrograms 2,3-diethyl-5-methylpyrazine per gram of the liquid tobacco extract, more preferably at least $3.50\times10^{-2}$ micrograms 2,3-diethyl-5-methylpyrazine per gram of the liquid tobacco extract, even more preferably at least $5.00\times10^{-2}$ micrograms 2,3-diethyl-5-methylpyrazine per gram of the liquid tobacco extract, most preferably at least $7.50\times10^{-2}$ micrograms 2,3-diethyl-5-methylpyrazine per gram of the liquid tobacco extract. In particularly preferred embodiments, the liquid tobacco extract comprises at least $9.00\times10^{-2}$ micrograms 2,3-diethyl-5-methylpyrazine per gram of the liquid tobacco extract, preferably at least 0.100 micrograms 2,3-diethyl-5-methylpyrazine per gram of the liquid tobacco extract, more preferably at least 0.200 micrograms 2,3-diethyl-5-methylpyrazine per gram of the liquid tobacco extract, even more preferably at least 0.300 micrograms 2,3-diethyl-5-methylpyrazine per gram of the liquid tobacco extract, most preferably at least 0.400 micrograms 2,3-diethyl-5-methylpyrazine per gram of the liquid tobacco extract. The ratio by weight of (2,3-diethyl-5-methylpyrazine) to (phenol) may be greater than 0.0200, for example greater than 0.0300, preferably greater than 0.300, more preferably greater than 0.400, most preferably greater than 0.500, such as greater than 0.600. The ratio by weight of (2,3-diethyl-5-methylpyrazine) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.0300, for example greater than 0.0400, preferably greater than 0.100, more preferably greater than 0.500, most preferably greater than 0.800, such as greater than 0.900.

The liquid tobacco extract may comprise acetic acid. Acetic acid is a desirable compound which smoothens and reduces harshness of the aerosol that is generated.

The liquid tobacco extract may comprise at least 300 micrograms acetic acid per gram of the liquid tobacco extract, preferably at least 500 micrograms acetic acid per gram of the liquid tobacco extract, more preferably at least 700 micrograms acetic acid per gram of the liquid tobacco extract, most preferably at least 900 micrograms acetic acid per gram of the liquid tobacco extract. In preferred embodiments, the liquid tobacco extract comprises at least 1200 micrograms acetic acid per gram of the liquid tobacco extract, more preferably at least 1500 micrograms acetic acid per gram of the liquid tobacco extract, even more preferably at least 2000 micrograms acetic acid per gram of the liquid tobacco extract, most preferably at least 2500 micrograms acetic acid per gram of the liquid tobacco extract. In particularly preferred embodiments, the liquid tobacco extract comprises at least 3000 micrograms acetic acid per gram of the liquid tobacco extract, preferably at least 3500 micrograms acetic acid per gram of the liquid tobacco extract, more preferably at least 4000 micrograms acetic acid per gram of the liquid tobacco extract, even more preferably at least 4500 micrograms acetic acid per gram of the liquid tobacco extract, most preferably at least 5000 micrograms acetic acid per gram of the liquid tobacco extract. The ratio by weight of (acetic acid) to (phenol) may be greater than 1500, for example greater than 2000, preferably greater than 2500, more preferably greater than 3000, most preferably greater than 3100, such as greater than 5000. The ratio by weight of (acetic acid) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 2100, for example greater than 2800, preferably greater than 3000, more preferably greater than 4000, most preferably greater than 5500, such as greater than 7500.

The liquid tobacco extract may comprise vanillin. The liquid tobacco extract may comprise at least $3.00\times10^{-2}$ micrograms vanillin per gram of the liquid tobacco extract, preferably at least $5.00\times10^{-2}$ micrograms vanillin per gram of the liquid tobacco extract, more preferably at least $7.00\times10^{-2}$ micrograms vanillin per gram of the liquid tobacco extract, most preferably at least $9.00\times10^{-2}$ micrograms vanillin per gram of the liquid tobacco extract. In preferred embodiments, the liquid tobacco extract comprises at least 0.100 micrograms vanillin per gram of the liquid tobacco extract, more preferably at least 0.200 micrograms vanillin per gram of the liquid tobacco extract, even more preferably at least 0.300 micrograms vanillin per gram of the liquid tobacco extract, most preferably at least 0.400 micrograms vanillin per gram of the liquid tobacco extract. In particularly preferred embodiments, the liquid tobacco extract comprises at least 0.500 micrograms vanillin per gram of the liquid tobacco extract, preferably at least 0.600 micrograms vanillin per gram of the liquid tobacco extract, more preferably at least 0.700 micrograms vanillin per gram of the liquid tobacco extract, even more preferably at least 0.800 micrograms vanillin per gram of the liquid tobacco extract, most preferably at least 0.900 micrograms vanillin per gram of the liquid tobacco extract. The ratio by weight of (vanillin) to (phenol) may be greater than 1500, for example greater than 2000, preferably greater than 2500, more preferably greater than 3000, most preferably greater than 3100, such as greater than 5000. The ratio by weight of (vanillin) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.110, for example greater than 0.150, preferably greater than 0.160, more preferably greater than 0.200, most preferably greater than 0.300, such as greater than 0.500.

The liquid tobacco extract may comprise 2-ethyl-3,5-dimethylpyrazine. The liquid tobacco extract may comprise at least 0.0800 micrograms 2-ethyl-3,5-dimethylpyrazine per gram of the liquid tobacco extract, preferably at least 0.100 micrograms 2-ethyl-3,5-dimethylpyrazine per gram of the liquid tobacco extract, more preferably at least 0.200 micrograms 2-ethyl-3,5-dimethylpyrazine per gram of the liquid tobacco extract, most preferably at least 0.300 micrograms 2-ethyl-3,5-dimethylpyrazine per gram of the liquid tobacco extract. In preferred embodiments, the liquid tobacco extract comprises at least 0.500 micrograms 2-ethyl-3,5-dimethylpyrazine per gram of the liquid tobacco extract, more preferably at least 0.700 micrograms 2-ethyl-3,5-dimethylpyrazine per gram of the liquid tobacco extract, even more preferably at least 0.900 micrograms 2-ethyl-3,5-dimethylpyrazine per gram of the liquid tobacco extract, most preferably at least micrograms 2-ethyl-3,5-dimethylpyrazine per gram of the liquid tobacco extract. In particularly preferred embodiments, the liquid tobacco extract comprises at least 1.10 micrograms 2-ethyl-3,5-dimethylpyrazine per gram of the liquid tobacco extract, preferably at least 1.30 micrograms 2-ethyl-3,5-dimethylpyrazine per gram of the liquid tobacco extract, more preferably at least 1.50 micrograms 2-ethyl-3,5-dimethylpyrazine per gram of the liquid tobacco extract, even more preferably at least 1.70 micrograms 2-ethyl-3,5-dimethylpyrazine per gram of the liquid tobacco extract, most preferably at least 1.90 micrograms 2-ethyl-3,5-dimethylpyrazine per gram of the liquid tobacco extract. The ratio by weight of (2-ethyl-3,5-dimethylpyrazine) to (phenol) may be greater than 0.100, for example greater than 0.400, preferably greater than 1.00, more preferably greater than 1.50, most preferably greater than 2.00, such as greater than 2.50. The ratio by weight of (2-ethyl-3,5-dimethylpyrazine) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.500, for example greater than 0.750, preferably greater than 1.00, more preferably greater than 2.00, most preferably greater than 3.00, such as greater than 3.50.

The liquid tobacco extract may comprise 2-methylbutanoic acid. The liquid tobacco extract may comprise at least 1.00 micrograms 2-methylbutanoic acid per gram of the liquid tobacco extract, preferably at least 2.00 micrograms 2-methylbutanoic acid per gram of the liquid tobacco extract, more preferably at least 3.00 micrograms 2-methylbutanoic acid per gram of the liquid tobacco extract, most preferably at least 5.00 micrograms 2-methylbutanoic acid per gram of the liquid tobacco extract. In preferred embodiments, the liquid tobacco extract comprises at least 6.00 micrograms 2-methylbutanoic acid per gram of the liquid tobacco extract, more preferably at least 7.00 micrograms 2-methylbutanoic acid per gram of the liquid tobacco extract, even more preferably at least 8.00 micrograms 2-methylbutanoic acid per gram of the liquid tobacco extract, most preferably at least micrograms 2-methylbutanoic acid per gram of the liquid tobacco extract. In particularly preferred embodiments, the liquid tobacco extract comprises at least 9.00 micrograms 2-methylbutanoic acid per gram of the liquid tobacco extract, preferably at least 10.0 micrograms 2-methylbutanoic acid per gram of the liquid tobacco extract, more preferably at least 12.0 micrograms 2-methylbutanoic acid per gram of the liquid tobacco extract, even more preferably at least 14.0 micrograms 2-methylbutanoic acid per gram of the liquid tobacco extract, most preferably at least 15.0 micrograms 2-methylbutanoic acid per gram of the liquid tobacco extract. The ratio by weight of (2-methylbutanoic acid) to (phenol) may be greater than 7.00, for example greater than 9.00, preferably greater than 15.0, more preferably greater than 17.0, most preferably greater than 20.0, such as greater than 21.0. The ratio by weight of (2-methylbutanoic acid) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 12.0, for example greater than 17.0, preferably greater than 20.0, more preferably greater than 25.0, most preferably greater than 30.0, such as greater than 32.0.

The liquid tobacco extract may comprise 3-methylbutanoic acid. The liquid tobacco extract may comprise at least 2.00 micrograms 3-methylbutanoic acid per gram of the liquid tobacco extract, preferably at least 3.00 micrograms 3-methylbutanoic acid per gram of the liquid tobacco extract, more preferably at least 4.00 micrograms 3-methylbutanoic acid per gram of the liquid tobacco extract, most preferably at least 5.00 micrograms 3-methylbutanoic acid per gram of the liquid tobacco extract. In preferred embodiments, the liquid tobacco extract comprises at least 6.00 micrograms 3-methylbutanoic acid per gram of the liquid tobacco extract, more preferably at least 8.00 micrograms 3-methylbutanoic acid per gram of the liquid tobacco extract, even more preferably at least 10.0 micrograms 3-methylbutanoic acid per gram of the liquid tobacco extract, most preferably at least micrograms 3-methylbutanoic acid per gram of the liquid tobacco extract. In particularly preferred embodiments, the liquid tobacco extract comprises at least 15.0 micrograms 3-methylbutanoic acid per gram of the liquid tobacco extract, preferably at least 20.0 micrograms 3-methylbutanoic acid per gram of the liquid tobacco extract, more preferably at least 25.0 micrograms 3-methylbutanoic acid per gram of the liquid tobacco extract, even more preferably at least 30.0 micrograms 3-methylbutanoic acid per gram of the liquid tobacco extract, most preferably at least 35.0 micrograms 3-methylbutanoic acid per gram of the liquid tobacco extract. The ratio by weight of (3-methylbutanoic acid) to (phenol) may be greater than 11.0, for example greater than 15.0, preferably greater than 20.0, more preferably greater than 30.0, most preferably greater than 50.0, such as greater than 51.0. The ratio by weight of (3-methylbutanoic acid) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 18.0, for example greater than 40.0, preferably greater than 50.0, more preferably greater than 60.0, most preferably greater than 65.0, such as greater than 70.0.

The liquid tobacco extract may comprise 3-methyl-2,4-nonanedione. The liquid tobacco extract may comprise at least $6.00\times10^{-3}$ micrograms 3-methyl-2,4-nonanedione per gram of the liquid tobacco extract, preferably at least $8.00\times10^{-3}$ micrograms 3-methyl-2,4-nonanedione per gram of the liquid tobacco extract, more preferably at least $9.00\times10^{-3}$ micrograms 3-methyl-2,4-nonanedione per gram of the liquid tobacco extract, most preferably at least 0.0100 micrograms 3-methyl-2,4-nonanedione per gram of the liquid tobacco extract. In preferred embodiments, the liquid tobacco extract comprises at least 0.0300 micrograms 3-methyl-2,4-nonanedione per gram of the liquid tobacco extract, more preferably at least 0.0500 micrograms 3-methyl-2,4-nonanedione per gram of the liquid tobacco extract, even more preferably at least 0.0700 micrograms 3-methyl-2,4-nonanedione per gram of the liquid tobacco extract, most preferably at least micrograms 3-methyl-2,4-nonanedione per gram of the liquid tobacco extract. In particularly preferred embodiments, the liquid tobacco extract comprises at least 0.0900 micrograms 3-methyl-2,4-nonanedione per gram of the liquid tobacco extract, preferably at least 0.100 micrograms 3-methyl-2,4-nonanedione per gram of the liquid tobacco extract, more preferably at least 0.150 micrograms 3-methyl-2,4-nonanedione per gram of the liquid tobacco extract, even more preferably at least 0.200 micrograms 3-methyl-2,4-nonanedione per gram of the liquid tobacco extract, most preferably at least 0.250 micrograms 3-methyl-2,4-nonanedione per gram of the liquid tobacco extract. The ratio by weight of (3-methyl-2,4-nonanedione) to (phenol) may be greater than 0.100, for example greater than 0.125, preferably greater than 0.150, more preferably greater than 0.250, most preferably greater than 0.225, such as greater than 0.250. The ratio by weight of (3-methyl-2,4-nonanedione) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.035, for example greater than 0.040, preferably greater than 0.080, more preferably greater than 0.090, most preferably greater than 0.100, such as greater than 0.130.

The liquid tobacco extract may comprise 2-methoxyphenol. The liquid tobacco extract may comprise at least 0.150 micrograms 2-methoxyphenol per gram of the liquid tobacco extract, preferably at least 0.300 micrograms 2-methoxyphenol per gram of the liquid tobacco extract, more preferably at least 0.500 micrograms 2-methoxyphenol per gram of the liquid tobacco extract, most preferably at least 0.600 micrograms 2-methoxyphenol per gram of the liquid tobacco extract. In preferred embodiments, the liquid tobacco extract comprises at least 0.700 micrograms 2-methoxyphenol per gram of the liquid tobacco extract, more preferably at least 0.800 micrograms 2-methoxyphenol per gram of the liquid tobacco extract, even more preferably at least 0.900 micrograms 2-methoxyphenol per gram of the liquid tobacco extract, most preferably at least micrograms 2-methoxyphenol per gram of the liquid tobacco extract. In particularly preferred embodiments, the liquid tobacco extract comprises at least 1.00 micrograms 2-methoxyphenol per gram of the liquid tobacco extract, preferably at least 1.50 micrograms 2-methoxyphenol per gram of the liquid tobacco extract, more preferably at least 2.00 micrograms 2-methoxyphenol per gram of the liquid tobacco extract, even more preferably at least 2.50 micrograms 2-methoxyphenol per gram of the liquid tobacco extract, most preferably at least 3.00 micrograms 2-methoxyphenol per gram of the liquid tobacco extract. The ratio by weight of (2-methoxyphenol) to (phenol) may be greater than 0.0900, for example greater than 1.00, preferably greater than 1.50, more preferably greater than 2.00, most preferably greater than 3.00, such as greater than 4.50. The ratio by weight of (2-methoxyphenol) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 1.40, for example greater than, preferably greater than 1.80, more preferably greater than 2.00, most preferably greater than 3.00, such as greater than 6.00.

The liquid tobacco extract may comprise 2-phenylethanol. The liquid tobacco extract may comprise at least 1.50 micrograms 2-phenylethanol per gram of the liquid tobacco extract, preferably at least 3.00 micrograms 2-phenylethanol per gram of the liquid tobacco extract, more preferably at least 5.00 micrograms 2-phenylethanol per gram of the liquid tobacco extract, most preferably at least 7.00 micrograms 2-phenylethanol per gram of the liquid tobacco extract. In preferred embodiments, the liquid tobacco extract comprises at least 9.00 micrograms 2-phenylethanol per gram of the liquid tobacco extract, more preferably at least 10.0 micrograms 2-phenylethanol per gram of the liquid tobacco extract, even more preferably at least 11.0 micrograms 2-phenylethanol per gram of the liquid tobacco extract, most preferably at least micrograms 2-phenylethanol per gram of the liquid tobacco extract. In particularly preferred embodiments, the liquid tobacco extract comprises at least 13.0 micrograms 2-phenylethanol per gram of the liquid tobacco extract, preferably at least 15.0 micrograms 2-phenylethanol per gram of the liquid tobacco extract, more preferably at least 16.0 micrograms 2-phenylethanol per gram of the liquid tobacco extract, even more preferably at least 17.0 micrograms 2-phenylethanol per gram of the liquid tobacco extract, most preferably at least 18.0 micrograms 2-phenylethanol per gram of the liquid tobacco extract. The ratio by weight of (2-phenylethanol) to (phenol) may be greater than 3.00, for example greater than 5.00, preferably greater than 8.00, more preferably greater than 9.00, most preferably greater than 10.0, such as greater than 25.0. The ratio by weight of (2-phenylethanol) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 10.0, for example greater than 13.0, preferably greater than 14.0, more preferably greater than 15.0, most preferably greater than 17.0, such as greater than 35.0.

The liquid tobacco extract may comprise eugenol. The liquid tobacco extract may comprise at least 0.0600 micrograms eugenol per gram of the liquid tobacco extract, preferably at least 0.0650 micrograms eugenol per gram of the liquid tobacco extract, more preferably at least 0.0700 micrograms eugenol per gram of the liquid tobacco extract, most preferably at least 0.0800 micrograms eugenol per gram of the liquid tobacco extract. In preferred embodiments, the liquid tobacco extract comprises at least 0.0900 micrograms eugenol per gram of the liquid tobacco extract, more preferably at least 0.100 micrograms eugenol per gram of the liquid tobacco extract, even more preferably at least 0.200 micrograms eugenol per gram of the liquid tobacco extract, most preferably at least micrograms eugenol per gram of the liquid tobacco extract. In particularly preferred embodiments, the liquid tobacco extract comprises at least 0.300 micrograms eugenol per gram of the liquid tobacco extract, preferably at least 0.400 micrograms eugenol per gram of the liquid tobacco extract, more preferably at least 0.500 micrograms eugenol per gram of the liquid tobacco extract, even more preferably at least 0.600 micrograms eugenol per gram of the liquid tobacco extract, most preferably at least 0.700 micrograms eugenol per gram of the liquid tobacco extract. The ratio by weight of (eugenol) to (phenol) may be greater than 0.100, for example greater than 0.0500, preferably greater than 0.150, more preferably greater than 0.250, most preferably greater than 0.300, such as greater than 1.20. The ratio by weight of (eugenol) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.0200, for example greater than 0.0250, preferably greater than 0.0300, more preferably greater than 0.500, most preferably greater than 0.550, such as greater than 1.50.

The liquid tobacco extract may comprise sotolone. The liquid tobacco extract may comprise at least $3.00\times10^{-3}$ micrograms sotolone per gram of the liquid tobacco extract, preferably at least $5.00\times10^{-3}$ micrograms sotolone per gram of the liquid tobacco extract, more preferably at least $7.00\times10^{-3}$ micrograms sotolone per gram of the liquid tobacco extract, most preferably at least $9.00\times10^{-3}$ micrograms sotolone per gram of the liquid tobacco extract. In preferred embodiments, the liquid tobacco extract comprises at least 0.0100 micrograms sotolone per gram of the liquid tobacco extract, more preferably at least 0.0200 micrograms sotolone per gram of the liquid tobacco extract, even more preferably at least 0.0300 micrograms sotolone per gram of the liquid tobacco extract, most preferably at least micrograms sotolone per gram of the liquid tobacco extract. In particularly preferred embodiments, the liquid tobacco extract comprises at least 0.0400 micrograms sotolone per gram of the liquid tobacco extract, preferably at least 0.0500 micrograms sotolone per gram of the liquid tobacco extract, more preferably at least 0.0600 micrograms sotolone per gram of the liquid tobacco extract, even more preferably at least 0.0700 micrograms sotolone per gram of the liquid tobacco extract, most preferably at least 0.0800 micrograms sotolone per gram of the liquid tobacco extract. The ratio by weight of (sotolone) to (phenol) may be greater than 0.0200, for example greater than 0.0400, preferably greater than 0.150, more preferably greater than 0.0450, most preferably greater than 0.0500, such as greater than 0.0510. The ratio by weight of (sotolone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600) may be greater than 0.0300, for example greater than 0.0400, preferably greater than 0.0500, more preferably greater than 0.0600, most preferably greater than 0.0700, such as greater than 0.0750.

Aside from phenol, the TSNAs NNK, NAT, NAB and NNN, and 2-furanemethanol, other undesirable compounds that may be present in the liquid tobacco extract but are minimised by the extraction method described herein include formaldehyde (sugar-derived) and acetaldehyde, phenolic compounds such as catechol, hydroquinone, m-cresol, o-cresol and p-cresol, and nitrogen containing compounds such as ammonia, acetamide, pyridine, 3-aminobiphenyl, 4-aminobiphenyl and o-toludine.

The liquid tobacco extract may comprise at most 12.0 micrograms phenol per gram of the liquid tobacco extract, for example at most 10.0 micrograms phenol per gram of the liquid tobacco extract, preferably at most 8.00 micrograms phenol per gram of the liquid tobacco extract, more preferably at most 6.00 micrograms phenol per gram of the liquid tobacco extract, even more preferably at most 4.00 micrograms phenol per gram of the liquid tobacco extract, most preferably at most 2.00 micrograms phenol per gram of the liquid tobacco extract.

The liquid tobacco extract may comprise at most 0.045 micrograms 4-(methylnitrosamino)-1-(3-pyridyl)-1-butanone (NNK) per gram of the liquid tobacco extract, for example at most 0.040 micrograms NNK per gram of the liquid tobacco extract, preferably at most 0.035 micrograms NNK per gram of the liquid tobacco extract, more preferably at most 0.030 micrograms NNK per gram of the liquid tobacco extract, even more preferably at most 0.025 micrograms NNK per gram of the liquid tobacco extract, most preferably at most 0.020 micrograms NNK per gram of the liquid tobacco extract.

The liquid tobacco extract may comprise at most 2.00 micrograms (R,S)—N-nitrosoanatabine (NAT) per gram of the liquid tobacco extract, for example at most micrograms NAT per gram of the liquid tobacco extract, preferably at most 1.50 micrograms NAT per gram of the liquid tobacco extract, more preferably at most 1.00 micrograms NAT per gram of the liquid tobacco extract, even more preferably at most 0.500 micrograms NAT per gram of the liquid tobacco extract, most preferably at most 0.300 micrograms NAT per gram of the liquid tobacco extract.

The liquid tobacco extract may comprise at most 1.60 micrograms (R,S)—N-nitrosoanabasine (NAB) per gram of the liquid tobacco extract, for example at most micrograms NAB per gram of the liquid tobacco extract, preferably at most 1.20 micrograms NAB per gram of the liquid tobacco extract, more preferably at most 0.500 micrograms NAB per gram of the liquid tobacco extract, even more preferably at most 0.300 micrograms NAB per gram of the liquid tobacco extract, most preferably at most 0.200 micrograms NAB per gram of the liquid tobacco extract.

The liquid tobacco extract may comprise at most 1.60 micrograms N-nitrosonornicotine (NNN) per gram of the liquid tobacco extract, for example at most micrograms NNN per gram of the liquid tobacco extract, preferably at most 1.20 micrograms NNN per gram of the liquid tobacco extract, more preferably at most 0.500 micrograms NNN per gram of the liquid tobacco extract, even more preferably at most 0.300 micrograms NNN per gram of the liquid tobacco extract, most preferably at most 0.200 micrograms NNN per gram of the liquid tobacco extract.

The liquid tobacco extract may comprise at most 1500 micrograms 2-furanemethanol per gram of the liquid tobacco extract, for example at most micrograms 2-furanemethanol per gram of the liquid tobacco extract, preferably at most 1200 micrograms 2-furanemethanol per gram of the liquid tobacco extract, more preferably at most 1000 micrograms 2-furanemethanol per gram of the liquid tobacco extract, even more preferably at most 900 micrograms 2-furanemethanol per gram of the liquid tobacco extract, most preferably at most 700 micrograms 2-furanemethanol per gram of the liquid tobacco extract.

The liquid tobacco extract may comprise at most 60 micrograms formaldehyde per gram of the liquid tobacco extract, for example at most micrograms formaldehyde per gram of the liquid tobacco extract, preferably at most 50 micrograms formaldehyde per gram of the liquid tobacco extract, more preferably at most 40 micrograms formaldehyde per gram of the liquid tobacco extract, even more preferably at most 30 micrograms formaldehyde per gram of the liquid tobacco extract, most preferably at most 20 micrograms formaldehyde per gram of the liquid tobacco extract.

The liquid tobacco extract may comprise at most 60 micrograms acetaldehyde per gram of the liquid tobacco extract, for example at most micrograms acetaldehyde per gram of the liquid tobacco extract, preferably at most 55 micrograms acetaldehyde per gram of the liquid tobacco extract, more preferably at most 45 micrograms acetaldehyde per gram of the liquid tobacco extract, even more preferably at most 35 micrograms acetaldehyde per gram of the liquid tobacco extract, most preferably at most 30 micrograms acetaldehyde per gram of the liquid tobacco extract.

The liquid tobacco extract may comprise at most 5.00 micrograms catechol per gram of the liquid tobacco extract, for example at most micrograms catechol per gram of the liquid tobacco extract, preferably at most 4.00 micrograms catechol per gram of the liquid tobacco extract, more preferably at most 3.00 micrograms catechol per gram of the liquid tobacco extract, even more preferably at most 2.00 micrograms catechol per gram of the liquid tobacco extract, most preferably at most 1.00 micrograms catechol per gram of the liquid tobacco extract.

The liquid tobacco extract may comprise at most 1.00 micrograms hydroquinone per gram of the liquid tobacco extract, for example at most 0.950 micrograms hydroquinone per gram of the liquid tobacco extract, preferably at most 0.900 micrograms hydroquinone per gram of the liquid tobacco extract, more preferably at most 0.850 micrograms hydroquinone per gram of the liquid tobacco extract, even more preferably at most 0.800 micrograms hydroquinone per gram of the liquid tobacco extract, most preferably at most 0.700 micrograms hydroquinone per gram of the liquid tobacco extract.

The liquid tobacco extract may comprise at most 1.30 micrograms m-cresol per gram of the liquid tobacco extract, for example at most 1.20 micrograms m-cresol per gram of the liquid tobacco extract, preferably at most 1.00 micrograms m-cresol per gram of the liquid tobacco extract, more preferably at most 0.800 micrograms m-cresol per gram of the liquid tobacco extract, even more preferably at most 0.600 micrograms m-cresol per gram of the liquid tobacco extract, most preferably at most 0.500 micrograms m-cresol per gram of the liquid tobacco extract.

The liquid tobacco extract may comprise at most 1.60 micrograms o-cresol per gram of the liquid tobacco extract, for example at most 1.30 micrograms o-cresol per gram of the liquid tobacco extract, preferably at most 1.10 micrograms o-cresol per gram of the liquid tobacco extract, more preferably at most 0.800 micrograms o-cresol per gram of the liquid tobacco extract, even more preferably at most 0.600 micrograms o-cresol per gram of the liquid tobacco extract, most preferably at most 0.400 micrograms o-cresol per gram of the liquid tobacco extract.

The liquid tobacco extract may comprise at most 2.10 micrograms p-cresol per gram of the liquid tobacco extract, for example at most 1.50 micrograms p-cresol per gram of the liquid tobacco extract, preferably at most 1.20 micrograms p-cresol per gram of the liquid tobacco extract, more preferably at most 1.00 micrograms p-cresol per gram of the liquid tobacco extract, even more preferably at most 0.900 micrograms p-cresol per gram of the liquid tobacco extract, most preferably at most 0.700 micrograms p-cresol per gram of the liquid tobacco extract.

The liquid tobacco extract may comprise at most 350 micrograms ammonia per gram of the liquid tobacco extract, for example at most 300 micrograms ammonia per gram of the liquid tobacco extract, preferably at most 275 micrograms ammonia per gram of the liquid tobacco extract, more preferably at most 250 micrograms ammonia per gram of the liquid tobacco extract, even more preferably at most 200 micrograms ammonia per gram of the liquid tobacco extract, most preferably at most 175 micrograms ammonia per gram of the liquid tobacco extract.

The liquid tobacco extract may comprise at most 250 micrograms acetamide per gram of the liquid tobacco extract, for example at most 225 micrograms acetamide per gram of the liquid tobacco extract, preferably at most 200 micrograms acetamide per gram of the liquid tobacco extract, more preferably at most 150 micrograms acetamide per gram of the liquid tobacco extract, even more preferably at most 100 micrograms acetamide per gram of the liquid tobacco extract, most preferably at most 70 micrograms acetamide per gram of the liquid tobacco extract.

The liquid tobacco extract may comprise at most 45 micrograms pyridine per gram of the liquid tobacco extract, for example at most 35 micrograms pyridine per gram of the liquid tobacco extract, preferably at most 25 micrograms pyridine per gram of the liquid tobacco extract, more preferably at most 20 micrograms pyridine per gram of the liquid tobacco extract, even more preferably at most 15 micrograms pyridine per gram of the liquid tobacco extract, most preferably at most 10 micrograms pyridine per gram of the liquid tobacco extract.

The liquid tobacco extract may be used to form a nicotine composition. The liquid tobacco extract may be further processed to form a nicotine composition. The liquid tobacco extract may be concentrated in a desiccation step to form a concentrated tobacco extract. A concentrated tobacco extract may be used to form a nicotine composition. One such concentrated tobacco extract typically contains less than about 20 percent by weight of water. Preferably, the concentrated tobacco extract comprises between 8 percent and 15 percent by weight water based on the weight of the concentrated tobacco extract.

The concentrated tobacco extract that may have a non-aqueous extraction solvent content of from about 65 percent to about 95 percent by weight, preferably from about 65 percent to 85 percent by weight, most preferably from about 75 percent to about 85 percent by weight. The non-aqueous extraction solvent is preferably triacetin, glycerine, propylene glycol, 1,3-propanediol or a mixture thereof.

The concentrated tobacco extract may be used directly to form a nicotine composition, without the need for addition of additional nicotine. The concentrated tobacco extract may be used directly to form a nicotine composition, without the need for addition of additional non-aqueous solvent. The concentrated tobacco extract may be used directly to form a nicotine composition, without the need for addition of additional water. The concentrated tobacco extract may be used directly to form a nicotine composition, without the need for addition of additional flavourants.

In one example embodiment, the liquid tobacco extract is a concentrated tobacco extract comprising 84 percent by weight propylene glycol, 12.5 percent by weight water, 1.2 percent by weight nicotine, 0.5 percent by weight acetic acid, and 1.8 percent by weight balance of other components, including desirable flavourant compounds derived from the extraction process as described herein.

According to the present disclosure, there is further provided a cartridge comprising a nicotine composition, wherein the nicotine composition comprises a liquid tobacco extract or a concentrated tobacco extract as described herein.

The nicotine composition may be a liquid nicotine composition or a gel nicotine composition.

The nicotine composition may be for use in an aerosol-generating system. In such an aerosol-generating system, the nicotine composition is typically heated within an aerosol-generating device.

As used herein, the term "aerosol-generating device" refers to a device comprising a heater element that interacts with the nicotine composition of the invention to produce an aerosol. During use, volatile compounds are released from the nicotine composition by heat transfer and entrained in air drawn through the aerosol generating device. As the released compounds cool they condense to form an aerosol that is inhaled by the consumer.

Upon heating of the nicotine composition, an aerosol is released containing the volatile compounds that have been collected from the tobacco starting material during the extraction process.

The nicotine composition comprises a liquid tobacco extract or a concentrated tobacco extract as described herein.

The nicotine composition may comprise at least about 10 percent by weight of the liquid tobacco extract. Preferably, the nicotine composition comprises at least about 20 percent by weight of the liquid tobacco extract. More preferably, the nicotine composition comprises at least about 30 percent by weight of the liquid tobacco extract. In preferred embodiments, the nicotine composition comprises at least about 40 percent by weight of the liquid tobacco extract, more preferably at least about 50 percent by weight of the liquid tobacco extract, even more preferably at least about 60 percent by weight of the liquid tobacco extract. In particularly preferred embodiments, the nicotine composition comprises at least about 65 percent by weight of the liquid tobacco extract, more preferably at least about 70 percent by weight of the liquid tobacco extract, even more preferably at least about 75 percent by weight of the liquid tobacco extract, most preferably at least about 80 percent by weight of the liquid tobacco extract.

In some embodiments, the nicotine composition may comprise the liquid tobacco extract, the liquid tobacco extract being a concentrated tobacco extract. The nicotine composition may comprise at least about 10 percent by weight of the concentrated tobacco extract. Preferably, the nicotine composition comprises at least about 20 percent by weight of the concentrated tobacco extract. More preferably, the nicotine composition comprises at least about 30 percent by weight of the concentrated tobacco extract. In preferred embodiments, the nicotine composition comprises at least about 40 percent by weight of the concentrated tobacco extract, more preferably at least about 50 percent by weight of the concentrated tobacco extract, even more preferably at least about 60 percent by weight of the concentrated tobacco extract. In particularly preferred embodiments, the nicotine composition comprises at least about 65 percent by weight of the concentrated tobacco extract, more preferably at least about 70 percent by weight of the concentrated tobacco extract, even more preferably at least about 75 percent by weight of the concentrated tobacco extract, most preferably at least about 80 percent by weight of the concentrated tobacco extract.

In some embodiments, the nicotine composition comprises from about 40 percent by weight to about 95 percent by weight of the liquid tobacco extract. More preferably, the nicotine composition comprises from about 40 percent by weight to about 95 percent by weight of the liquid tobacco extract. Even more preferably, the nicotine composition comprises from about 50 percent by weight to about 95 percent by weight of the liquid tobacco extract. Most preferably, the nicotine composition comprises from about 60 percent by weight to about 95 percent by weight of the liquid tobacco extract. In some particularly preferred embodiments, the nicotine composition comprises from about 70 percent by weight to about 95 percent by weight of the liquid tobacco extract, even more preferably from about 80 percent by weight to about 95 percent by weight of the liquid tobacco extract. The liquid tobacco extract may be concentrated tobacco extract.

In some embodiments, the nicotine composition comprises from about 40 percent by weight to about 90 percent by weight of the liquid tobacco extract. More preferably, the nicotine composition comprises from about 40 percent by weight to about 90 percent by weight of the liquid tobacco extract. Even more preferably, the nicotine composition comprises from about 50 percent by weight to about 90 percent by weight of the liquid tobacco extract. Most preferably, the nicotine composition comprises from about 60 percent by weight to about 90 percent by weight of the liquid tobacco extract. In some particularly preferred embodiments, the nicotine composition comprises from about 70 percent by weight to about 90 percent by weight of the liquid tobacco extract, even more preferably from about 80 percent by weight to about 90 percent by weight of the liquid tobacco extract. The liquid tobacco extract may be concentrated tobacco extract.

In some embodiments, the nicotine composition comprises from about 40 percent by weight to about 85 percent by weight of the liquid tobacco extract. More preferably, the nicotine composition comprises from about 40 percent by weight to about 85 percent by weight of the liquid tobacco extract. Even more preferably, the nicotine composition comprises from about 85 percent by weight to about 90 percent by weight of the liquid tobacco extract. Most preferably, the nicotine composition comprises from about 60 percent by weight to about 85 percent by weight of the liquid tobacco extract. In some particularly preferred embodiments, the nicotine composition comprises from about 70 percent by weight to about 85 percent by weight of the liquid tobacco extract, even more preferably from about 80 percent by weight to about 85 percent by weight of the liquid tobacco extract. The liquid tobacco extract may be concentrated tobacco extract.

The nicotine composition may comprise up to about 100 percent by weight of the liquid tobacco extract. In some embodiments, the nicotine composition may be formed directly from the liquid tobacco extract without the need for addition of additional non-aqueous solvent, flavourants or nicotine. That is to say, the nicotine composition may comprise 100 percent by weight of the liquid tobacco extract. In some embodiments, the liquid tobacco extract is concentrated tobacco extract, such that the nicotine composition may comprise 100 percent by weight of concentrated tobacco extract. In embodiments in which the nicotine composition comprises 100 percent by weight of the liquid tobacco extract or 100 percent by weight of the concentrated tobacco extract, additional non-aqueous solvent is not present.

Alternatively, in some embodiments, the nicotine composition comprising the liquid tobacco extract may comprise additional non-aqueous solvent. Additional non-aqueous solvent is non-aqueous solvent that has been added after the extraction step. Additional non-aqueous solvent is solvent that is supplemental to the non-aqueous extraction solvent present in the liquid tobacco extract. In embodiments in which the liquid tobacco extract is concentrated tobacco extract, the nicotine composition comprising concentrated tobacco extract may comprise additional non-aqueous solvent. The total content of non-aqueous solvent in the nicotine composition includes the non-aqueous extraction solvent and the additional non-aqueous solvent, if it is present.

The additional non-aqueous solvent may be an aerosol former. Preferably, the additional non-aqueous solvent is triacetin, glycerine, propylene glycol, 1,3-propanediol or a mixture thereof.

In embodiments in which the nicotine composition comprises additional non-aqueous solvent, the nicotine composition may comprise 90 percent by weight or less of the additional non-aqueous solvent. Preferably, the nicotine composition comprises 80 percent by weight or less of the additional non-aqueous solvent. More preferably, the nicotine composition comprises 70 percent by weight or less of the additional non-aqueous solvent. In preferred embodiments, the nicotine composition comprises about 60 percent by weight or less of the additional non-aqueous solvent, more preferably about 50 percent by weight or less of the additional non-aqueous solvent, even more preferably about 40 percent by weight or less of the additional non-aqueous solvent. In particularly preferred embodiments, the nicotine composition comprises about 35 percent by weight or less of the additional non-aqueous solvent, more preferably about 30 percent by weight or less of the additional non-aqueous solvent, even more preferably about 25 percent by weight or less of the additional non-aqueous solvent, most preferably about 20 percent by weight or less of a liquid tobacco extract.

By way of example, a nicotine composition may comprise 80 percent by weight concentrated tobacco extract and 20 percent by weight additional non-aqueous solvent. In this example, the nicotine composition comprises 20 percent by weight glycerine as the additional non-aqueous solvent and 80 percent by weight concentrated tobacco extract, the concentrated tobacco extract comprising 84 percent by weight propylene glycol, 12.5 percent by weight water, 1.2 percent by weight nicotine, 0.5 percent by weight total acetic acid, and 1.8 percent by weight balance of other components, including desirable flavourant compounds derived from the extraction process as described herein. The nicotine composition of this example embodiment therefore comprises 20 percent by weight glycerine, 67.2 percent by weight propylene glycol, 10 percent by weight water, 0.96 percent by weight nicotine, 0.4 percent by weight total acetic acid, and 1.44 percent by weight balance of other components, including desirable flavourant compounds derived from the extraction process as described herein. This composition comprises a total content of 87.2 percent by weight non-aqueous solvent, the non-aqueous solvent comprising glycerine and propylene glycol.

Additional nicotine, water, non-aqueous solvent and flavourant compounds may be added to the liquid tobacco extract or the concentrated tobacco extract to form a nicotine composition.

Additional nicotine may be added to the liquid tobacco extract to form a nicotine composition. At least 50 percent by weight based on the total weight of the nicotine composition of the nicotine content in the nicotine composition may come from the liquid tobacco extract as opposed to being added following extraction. Preferably, at least 80 percent by weight based on the total weight of the nicotine composition of the nicotine content in the nicotine composition comes from the liquid tobacco extract as opposed to being added following extraction. More preferably, at least 90 percent by weight based on the total weight of the nicotine composition of the nicotine content in the nicotine composition comes from the liquid tobacco extract as opposed to being added following extraction. Even more preferably, 100 percent by weight based on the total weight of the nicotine composition of the nicotine content in the nicotine composition comes from the liquid tobacco extract as opposed to being added following extraction.

Additional non-aqueous solvent may be added to the liquid tobacco extract to form a nicotine composition. At least 50 percent by weight based on the total weight of the nicotine composition of the non-aqueous extraction solvent content in the nicotine composition may come from the liquid tobacco extract as opposed to being added following extraction. Preferably, at least 80 percent by weight based on the total weight of the nicotine composition of the non-aqueous extraction solvent content in the nicotine composition comes from the liquid tobacco extract as opposed to being added following extraction. Even more preferably, at least 90 percent by weight based on the total weight of the nicotine composition of the non-aqueous extraction solvent content in the nicotine composition comes from the liquid tobacco extract as opposed to being added following extraction.

Additional water may be added to the liquid tobacco extract to form a nicotine composition. At least 50 percent by weight based on the total weight of the nicotine composition of the water content in the nicotine composition may come from the liquid tobacco extract as opposed to being added following extraction. Preferably, at least 80 percent by weight based on the total weight of the nicotine composition of the water content in the nicotine composition comes from the liquid tobacco extract as opposed to being added following extraction. Even more preferably, at least 90 percent by weight based on the total weight of the nicotine composition of the water content in the nicotine composition comes from the liquid tobacco extract as opposed to being added following extraction.

Additional flavourant compounds may be added to the liquid tobacco extract to form a nicotine composition. At least 50 percent by weight based on the total weight of the nicotine composition of the desirable tobacco flavour species content in the nicotine composition may come from the liquid tobacco extract as opposed to being added following extraction. Preferably, at least 80 percent by weight based on the total weight of the nicotine composition of the desirable tobacco flavour species content in the nicotine composition comes from the liquid tobacco extract as opposed to being added following extraction. More preferably, at least 90 percent by weight based on the total weight of the nicotine composition of the desirable tobacco flavour species content in the nicotine composition comes from the liquid tobacco extract as opposed to being added following extraction. Even more preferably, 100 percent by weight based on the total weight of the nicotine composition of the desirable tobacco flavour species in the nicotine composition comes from the liquid tobacco extract as opposed to being added following extraction.

By way of example, at least 50 percent by weight based on the total weight of the nicotine composition of the β-ionone content in the nicotine composition may come from the tobacco extract as opposed to being added following extraction. Preferably, at least 80 percent by weight based on the total weight of the nicotine composition of the β-ionone content in the nicotine composition comes from the tobacco extract as opposed to being added following extraction. More preferably, at least 90 percent by weight based on the total weight of the nicotine composition of the β-ionone content in the nicotine composition comes from the tobacco extract as opposed to being added following extraction. Even more preferably, 100 percent by weight based on the total weight of the nicotine composition of the β-ionone content in the nicotine composition comes from the tobacco extract as opposed to being added following extraction.

As another example, at least 50 percent by weight based on the total weight of the nicotine composition of the β-damascenone content in the nicotine composition may come from the tobacco extract as opposed to being added following extraction. Preferably, at least 80 percent by weight based on the total weight of the nicotine composition of the β-damascenone content in the nicotine composition comes from the tobacco extract as opposed to being added following extraction. More preferably, at least 90 percent by weight based on the total weight of the nicotine composition of the β-damascenone content in the nicotine composition comes from the tobacco extract as opposed to being added following extraction. Even more preferably, 100 percent by weight based on the total weight of the nicotine composition of the β-damascenone content in the nicotine composition comes from the tobacco extract as opposed to being added following extraction.

In some embodiments, the nicotine composition may comprise one or more water-soluble organic acids. As used herein with reference to the invention, the term "water-soluble organic acid" describes an organic acid having a water solubility at 20° C. of greater than or equal to about 500 mg/ml.

The one or more water-soluble organic acids may advantageously bind nicotine in the liquid tobacco extract through formation of one or nicotine salts. The one or more nicotine salts may advantageously be dissolved and stabilised in the water present in the liquid tobacco extract or in the non-aqueous solvent. This may advantageously reduce nicotine adsorption in the upper airways and enhance pulmonary nicotine delivery and retention.

More preferably, the nicotine composition comprises one or more water-soluble carboxylic acids. Suitable water-soluble carboxylic acids include, but are not limited to, acetic acid, citric acid, lactic acid, levulinic acid, malic acid, malonic acid and pyruvic acid. Most preferably, the nicotine composition comprises lactic acid.

Preferably, the nicotine composition has a water-soluble organic acid content of greater than or equal to about 2 percent by weight. More preferably, the nicotine composition has a water-soluble organic acid content of greater than or equal to about 3 percent by weight.

The water-soluble organic acid may be acetic acid. Acetic acid derived from the extraction process may be present in the nicotine composition, or acetic acid may be added after the extraction process. Additional acetic acid is acetic acid that has been added after the extraction process.

If acetic acid is added to the liquid tobacco extract to form the nicotine composition, then the total content of acetic acid in the nicotine composition, including both acetic acid derived from the extraction process and additional acetic acid, is preferably from about 0.01 percent to about 8 percent by weight, for example between about 0.03 percent to about 8 percent by weight, from about 0.3 percent to about 8 percent by weight, from about 2 percent to about 8 percent by weight, or from about 3 percent to about 8 percent by weight. More preferably, the total acetic acid content is from about 0.01 percent to about 6 percent by weight, for example between about 0.03 percent to about 6 percent by weight, from about 0.3 percent to about 6 percent by weight, from about from about 2 percent to about 6 percent by weight, or from about 3 percent to about 6 percent by weight.

Preferably, the nicotine composition has a water-soluble organic acid content of less than or equal to about 8 percent by weight. More preferably, the nicotine composition has a water-soluble organic acid content of less than or equal to about 6 percent by weight.

Preferably, the nicotine composition has a water-soluble organic acid content of between about 2 percent by weight and about 8 percent by weight. For example, the nicotine composition may have a water-soluble organic acid content of between about 2 percent by weight and about 6 percent by weight.

More preferably, the nicotine composition has a water-soluble organic acid content of between about 3 percent by weight and about 8 percent by weight. For example, the nicotine composition may have a water-soluble organic acid content of between about 3 percent by weight and about 6 percent by weight.

The nicotine composition may comprise one or more non-tobacco-derived flavourants that may be added to the liquid tobacco extract during formation of the nicotine composition. Suitable non-tobacco-derived flavourants include, but are not limited to, menthol.

Preferably, the nicotine composition has a non-tobacco-derived flavourant content of less than or equal to about 4 percent by weight. More preferably, the nicotine composition has a non-tobacco-derived flavourant content of less than or equal to about 3 percent by weight.

The nicotine composition may comprise non-aqueous solvent, water, nicotine and flavourant compounds, as described previously herein.

The nicotine composition may comprise a total content of non-aqueous solvent of from about 10 percent to about 95 percent by weight. The nicotine composition preferably comprises a total content of non-aqueous solvent of from about 50 percent to about 95 percent by weight, for example from about 65 percent to about 95 percent by weight, more preferably from about 70 to about 90 percent by weight, most preferably from about 80 percent to about 90 percent by weight. The non-aqueous solvent is preferably triacetin, glycerine, propylene glycol, 1,3-propanediol or a mixture thereof.

The nicotine composition may comprise a total content of propylene glycol of from about 10 percent to about 95 percent by weight. The nicotine composition may comprise a total content of propylene glycol of from about 20 percent to about 95 percent by weight, such as from about 50 percent to about 95 percent by weight, or from about 65 percent to about 95 percent by weight, from about 70 to about 90 percent by weight, or from about 80 percent to about 90 percent by weight.

The nicotine composition may comprise a total content of triacetin of from about 10 percent to about 95 percent by weight. The nicotine composition may comprise a total content of triacetin of from about 20 percent to about 95 percent by weight, such as from about 50 percent to about 95 percent by weight, from about 70 to about 90 percent by weight or from about 65 percent to about 95 percent by weight, or from about 80 percent to about 90 percent by weight.

The nicotine composition may comprise a total content of glycerine of from about 10 percent to about 95 percent by weight. The nicotine composition may comprise a total content of glycerine of from about 20 percent to about 95 percent by weight, such as from about 50 percent to about 95 percent by weight, or from about 65 percent to about 95 percent by weight, from about 70 to about 90 percent by weight or from about 80 percent to about 90 percent by weight.

The nicotine composition may comprise a total content of 1,3-propanediol of from about 10 percent to about 95 percent by weight. The nicotine composition may comprise a total content of 1,3-propanediol of from about 20 percent to about 95 percent by weight, such as from about 50 percent to about 95 percent by weight, or from about 65 percent to about 95 percent by weight, or from about 80 percent to about 90 percent by weight.

The nicotine composition of the present invention comprises at least 0.2 percent by weight of nicotine. More preferably, the nicotine content in the nicotine composition is at least about 0.4 percent by weight. The nicotine composition may have a nicotine content of about 12 percent by weight or less, for example about 10 percent by weight or less, preferably about 8 percent by weight by weight or less, more preferably about 5 percent by weight or less, preferably about 3.6 percent by weight or less. Most preferably, the nicotine composition comprises between about 0.4 percent by weight and 3.6 percent by weight nicotine, based on the weight of the nicotine composition.

The nicotine composition may comprise between 1 percent and 85 percent by weight of water. The nicotine composition may comprise between 2 percent and 50 percent by weight of water. The nicotine composition may comprise between 3 percent and 30 percent by weight of water. The nicotine composition may comprise between 5 percent and 25 percent by weight of water. The nicotine composition may comprise between 8 percent and 20 percent by weight of water. The nicotine composition preferably comprises between 10 percent and 15 percent by weight water.

The nicotine composition may be a gel nicotine composition. As nicotine may be irritating to the skin, preventing any possible leakage of nicotine by locking the nicotine into a gel at room temperature is desirable. Such gels are described, for instance, in WO 2018/019543 A1.

Advantageously, the gel nicotine composition comprises a thermoreversible gel. This means that the gel will become fluid when heated to a melting temperature and will set into a gel again at a gelation temperature. The gelation temperature is preferably at or above room temperature and atmospheric pressure. Atmospheric pressure means a pressure of 1 atmosphere. The melting temperature is preferably higher than the gelation temperature. Preferably the melting temperature of the gel is above 50 degrees Celsius, or 60 degrees Celsius or 70 degrees Celsius and more preferably above 80 degrees Celsius. The melting temperature in this context means the temperature at which the gel is no longer solid and begins to flow.

The gel nicotine composition may comprise a suitable gelling agent. Preferably, the gel nicotine composition comprises agar, agarose, sodium alginate or Gellan gum. Most preferably, the gel nicotine composition comprises agar. The gel nicotine composition preferably comprises between about 0.5 percent and about 5 percent by weight gelling agent, more preferably between about 0.8 percent and about 1 percent by weight gelling agent.

The gel nicotine composition comprises the liquid tobacco extract. Preferably, the gel nicotine composition comprises between about 50 percent and about 99.5 percent of the liquid tobacco extract, more preferably between about 60 percent and about 99.5 percent of the liquid tobacco extract, even more preferably between about 70 percent and about 99.5 percent of the liquid tobacco extract, most preferably between about 80 percent and about 99.5 percent of the liquid tobacco extract.

The liquid tobacco extract may be concentrated tobacco extract, such that the gel nicotine composition may comprise concentrated tobacco extract. Preferably, the gel nicotine composition comprises between about 50 percent and about 99.5 percent of concentrated tobacco extract, more preferably between about 60 percent and about 99.5 percent of concentrated tobacco extract, even more preferably between about 70 percent and about 99.5 percent of concentrated tobacco extract, most preferably between about 80 percent and about 99.5 percent of concentrated tobacco extract.

The gel nicotine composition may comprise additional non-aqueous solvent. Preferably the gel nicotine composition comprises between about 5 percent and 49.5 percent, more preferably between about 10 percent and about 40 percent, even more preferably between about 15 percent and about 30 percent, most preferably between about 20 percent and about 30 percent of additional non-aqueous solvent. The additional non-aqueous solvent is preferably glycerine, propylene glycol, triacetin, 1,3-propanediol or a mixture thereof.

The total content of non-aqueous solvent in the gel nicotine composition includes the non-aqueous extraction solvent and the additional non-aqueous solvent, if it is present. The gel nicotine composition may comprise a total content of non-aqueous solvent of from about 10 percent to about 95 percent by weight. The gel nicotine composition preferably comprises a total content of non-aqueous solvent of from about 50 percent to about 95 percent by weight, for example from about 65 percent to about 95 percent by weight, more preferably from about 70 to about 90 percent by weight, most preferably from about 80 percent to about 90 percent by weight. The non-aqueous solvent is preferably triacetin, glycerine, propylene glycol, 1,3-propanediol or a mixture thereof.

The gel nicotine composition may comprise between 1 percent and 85 percent by weight of water. The gel nicotine composition may comprise between 2 percent and 50 percent by weight of water. The gel nicotine composition may preferably comprise between 3 percent and 30 percent by weight of water. The gel nicotine composition may comprise between 8 percent and 20 percent by weight of water. The gel nicotine composition may comprise between 10 percent and 15 percent by weight water.

The gel nicotine composition comprises at least 0.2 percent by weight of nicotine. More preferably, the nicotine content in the gel nicotine composition is at least about 0.4 percent by weight. The gel nicotine composition may have a nicotine content of about 12 percent by weight or less, for example about 10 percent by weight or less, preferably about 8 percent by weight by weight or less, more preferably about 5 percent by weight or less, preferably about 3.6 percent by weight or less. Most preferably, the gel nicotine composition comprises between about 0.4 percent by weight and 3.6 percent by weight nicotine.

In one example embodiment, the gel nicotine composition comprises 80 percent by weight liquid tobacco extract, 19 percent by weight additional non-aqueous solvent and 1 percent agar. In this example embodiment, the nicotine composition comprises 19 percent by weight glycerine as the additional non-aqueous solvent and 80 percent by weight liquid tobacco extract, the liquid tobacco extract comprising 59 percent by weight glycerine, 37.5 percent by weight water, 1.2 percent by weight nicotine, 0.5 percent by weight total acetic acid, and 1.8 percent by weight balance of other components, including desirable flavourant compounds derived from the extraction process as described herein. The nicotine composition of this example embodiment therefore comprises 66.2 percent by weight glycerine, 30 percent by weight water, 0.96 percent by weight nicotine, 0.4 percent by weight total acetic acid, 1 percent agar and 1.44 percent by weight balance of other components, including desirable flavourant compounds derived from the extraction process as described herein.

The nicotine composition comprising the liquid tobacco extract may be provided in a cartridge for use in an aerosol-generating system. The cartridge may comprise an atomiser, configured to generate an aerosol from the nicotine composition. The atomiser may be a thermal atomiser, which is configured to heat the nicotine composition to generate an aerosol. The thermal atomiser may comprise, for example, a heater and a liquid transport element configured to transport the nicotine composition to the heater. The liquid transport element may comprise a capillary wick. Alternatively, the atomiser may be a non-thermal atomiser, which is configured to generate an aerosol from the nicotine composition by means other than heating. The non-thermal atomiser may be, for example, an impinging jet atomiser, an ultrasonic atomiser or a vibrating mesh atomiser.

The cartridge comprising the nicotine composition may be used in conjunction with any suitable aerosol-generating device comprising a housing configured to receive at least a portion of the cartridge. The aerosol-generating device may comprise a battery and control electronics.

The nicotine composition may be a gel nicotine composition or a liquid nicotine composition, as described herein, for use in an aerosol-generating system.

It is possible to adjust the liquid tobacco extract, as well as the characteristics of the resultant aerosol produced from the nicotine composition and delivered to the consumer, through control of the parameters of the extraction process.

According to the present invention there is provided a liquid tobacco extract comprising a non-aqueous solvent, nicotine, and a ratio by weight of (β-ionone+β-damascenone) to (phenol) of greater than 0.25, prepared by a method comprising the steps of: heating a tobacco starting material at an extraction temperature of between 100 degrees Celsius and 160 degrees Celsius for at least 90 minutes; collecting the volatile compounds released from the tobacco starting material during the heating step; and forming a liquid tobacco extract comprising the collected volatile compounds.

As discussed above, the liquid tobacco extract may be produced from a tobacco starting material consisting of a single type of natural tobacco. The tobacco starting material may comprise a blend of two or more types of natural tobaccos. Alternatively, the liquid tobacco extract may be produced from a blend produced from a first tobacco starting material consisting of a first single type of natural tobacco that is extracted to form a first extract, a second tobacco starting material consisting of a second single type of natural tobacco that is extracted to form a second extract, wherein the first extract and second extract are blended to form the liquid tobacco extract. Two or more extracts may be blended in this manner to form the liquid tobacco extract. The ratio of the different tobacco types may be adapted depending on the desired characteristics of the aerosol. For example, where it is desired to provide a relatively high level of nicotine, the proportion of Burley tobacco may be increased.

The term "natural tobacco" is used herein with reference to the present invention to describe any part of any plant member of the genus *Nicotiana*, including, but not limited to, leaves, midribs, stems and stalks. In particular, the natural tobacco may comprise flue-cured tobacco material, Burley tobacco material, Oriental tobacco material, Maryland tobacco material, dark tobacco material, dark-fired tobacco material, *Rustica* tobacco material, as well as material from other rare or specialty tobaccos, or blends thereof. As will be described in more detail below, the tobacco material may be whole (for example, whole tobacco leaves), shredded, cut or ground.

Where it is desired to produce a liquid tobacco extract from a combination of two of more different tobacco types, to form the liquid tobacco extract the tobacco types may be heated separately at different extraction temperatures within the defined range of 100 degrees Celsius to 160 degrees Celsius, or a mixture of the tobacco types may be heated together at a single extraction temperature within the range.

The tobacco starting material may be a solid tobacco material, such as a powder, leaf scraps or shreds, or intact leaf. Alternatively, the tobacco starting material may be a liquid tobacco material such as a dough, gel, slurry, or suspension.

The tobacco starting material may be derived from any suitable tobacco material, including but not limited to tobacco leaf, tobacco stem, reconstituted tobacco, cast tobacco, extruded tobacco or tobacco derived pellets.

Preferably, in the step of preparing the tobacco starting material, the tobacco is ground or cut in order to reduce the size of tobacco particles within the tobacco starting material. This may advantageously improve the homogeneity of heating of the tobacco starting material and the efficiency of the extraction.

The tobacco starting material may optionally be dried prior to the heating step in order to decrease the water content of the tobacco starting material. Drying of the tobacco starting material may be carried out by any suitable chemical or physical drying process. Alternatively, water may be added to the tobacco starting material prior to the heating step in order to increase the water content of the tobacco starting material.

The step of preparing the tobacco starting material may comprise the step of impregnating the tobacco starting material with an aerosol former. When this impregnation of the tobacco starting material is carried out prior to the heating step, it may advantageously increase the amount of certain desirable tobacco compounds that are released from the tobacco starting material upon heating. For example, impregnation of the tobacco starting material with glycerine has been found to advantageously increase the amount of nicotine that is extracted from the tobacco starting material. In another example, impregnation of the tobacco starting material with a non-aqueous extraction solvent that is also an aerosol former, such propylene glycol, glycerine, 1,3-propanediol, triacetin, or mixtures thereof has been found to advantageously increase the amount of flavour compounds that are extracted from the tobacco starting material.

Preferably, in the step of preparing the natural tobacco material, the tobacco is not subjected to any treatment adapted to alter the pH of the tobacco. In particular, in the step of preparing the natural tobacco material, the tobacco is not subjected to any treatment adapted to significantly increase the pH of the tobacco. For example, the natural tobacco material is not contacted with an aqueous solution containing a salt of an alkali or alkali-earth metal. Advantageously it has been found that maintaining the tobacco material in a less modified state may provide a more authentic or more natural flavour profile which may be appreciated by a consumer. Further, the inventors have found that subjecting the natural tobacco material to a treatment adapted to increase the pH of the tobacco, such as an alkali treatment, prior to heating the tobacco material as part of the extraction process leads to lower levels of desirable heated tobacco flavour compounds in the liquid tobacco extract. By way of example, not subjecting the natural tobacco material to an alkali treatment has been found to be associated with a significant increase in the weight ratio of (β-ionone+β-damascenone) to (phenol) in the liquid tobacco extract compared with an equivalent, alkali-treated natural tobacco material.

In preferred embodiments, the tobacco starting material consists of natural tobacco. As such, a water content in the tobacco starting material may be about 11 percent by weight (water content typically found in natural tobacco material).

In other embodiments, the tobacco starting material may comprise one or more additional ingredients, such as for example a non-aqueous solvent or added water or both. An example of a suitable solvent is propylene glycol.

The tobacco starting material may thus comprise at least about 40 percent by weight of natural tobacco material or at least about 60 percent by weight of natural tobacco material or at least about 80 percent by weight of natural tobacco material or at least about 90 percent by weight of natural tobacco material or at least about 95 percent by weight of natural tobacco material.

In some embodiments, the water content in the tobacco starting material may be from about 3 percent by weight to about 60 percent by weight, more preferably from about 3 percent by weight to about 20 percent by weight, even more preferably from about 3 percent by weight to about 12 percent by weight. In other embodiments, the water content in the tobacco starting material may be from about 5 percent by weight to about 60 percent by weight, more preferably from about 5 percent by weight to about 20 percent by weight, even more preferably from about 5 percent by weight to about 12 percent by weight. In further embodiments, the water content in the tobacco starting material may be from about 8 percent by weight to about 60 percent by weight, more preferably from about 8 percent by weight to about 20 percent by weight, even more preferably from about 8 percent by weight to about 12 percent by weight.

In some embodiments, the non-aqueous solvent content may be at least about 5 percent by weight or at least about 10 percent by weight or at least about 15 percent by weight or at least about 20 percent by weight or at least about 25 percent by weight or at least about 30 percent by weight or at least about 35 percent by weight or at least about 40 percent by weight.

Optionally, the tobacco starting material may be digested enzymatically prior to the heating step. This has been found to provide a significant increase in the yield of certain flavour compounds from the tobacco starting material.

The tobacco starting material may optionally be analysed prior to the heating step in order to determine the composition, for example, the content of reducing sugars of alkaloids. This information about the composition may helpfully be used to select an appropriate extraction temperature.

The extraction temperature and the duration of heating may be selected within the ranges defined depending upon factors such as the type of tobacco, possible other components of the tobacco starting material, the desired level of nicotine or the desired composition of the nicotine composition formed from the liquid tobacco extract. By controlling the combination of extraction temperature and time, the liquid tobacco extract can be adjusted depending on the desired characteristics of the aerosol generated from the nicotine composition. In particular, the proportion of specific tobacco compounds can be adjusted to a certain degree through the selection of the extraction parameters in order to maximise the ratio of desirable to undesirable tobacco compounds within the liquid tobacco extract and any resultant nicotine composition formed from the liquid tobacco extract.

For a specific tobacco compound, the variation in the level of release of the compound with extraction temperature during the extraction process can be readily determined for any given tobacco starting material. For example, it has been found that the level of nicotine released from a tobacco starting material will typically increase with increasing extraction temperature. The rate of increase has been found to vary for different tobacco types.

It has also been found that the level of desirable tobacco flavour compounds, such as β-damascenone and β-ionone, released from a tobacco material will increase with increasing extraction temperature up to a certain peak extraction temperature, after which the level will begin to decrease. The peak extraction temperature for such flavour compounds is typically within the range of 100 degrees Celsius to 160 degrees Celsius such that the level of desirable flavour compounds can be effectively optimised in the extraction method.

In methods in which tobacco material is soaked in a suitable liquid solvent, such as an aerosol former, at room temperature or below, for a period of several weeks in order to extract the tobacco constituents into the solvent, typically much lower constituent contents are obtained than those of the compositions of the present invention. Extraction processes in which the tobacco material is soaked in a suitable solvent, such as an aerosol former, at room temperature or below, do not generate compounds which are not present in the tobacco but generated by heat after a Maillard reaction has happened. One such compound that is generated by heat after a Maillard reaction has happened is furaneol. Furaneol is derived from the thermal treatment of the intrinsic reducing sugar content of the tobacco plant material with other tobacco plant constituents.

Bright tobaccos typically have a much higher reducing sugar content (up to 25% by weight) than Burley tobaccos, and the amount of furaneol released upon heating Bright tobaccos is found to vary significantly depending on the extraction temperature, with a direct correlation between the extraction temperature and the level of furaneol released. As described herein, the peak extraction temperature for such flavour compounds is typically within the range of 100 degrees Celsius to 160 degrees Celsius such that the level of such desirable flavour compounds can be effectively optimised in the extraction method.

Many undesirable tobacco compounds have been found to increase slowly with increasing extraction temperature up to a threshold temperature, beyond which a rapid increase is observed. This applies, for example, to the levels of phenol, other phenolic compounds and TSNAs, and in the case of Bright tobaccos, to the level of furans and formaldehyde. In many cases, the threshold temperature is within the range of 100 degrees Celsius to 160 degrees Celsius and therefore the level of the undesirable compounds can be effectively controlled in the extraction method.

It has been found by the inventors of the present invention that for certain tobacco types, the level of particular undesirable nitrogenous compounds, such as TSNAs, released during extraction is dependent upon the extraction temperature. For Bright tobaccos, the content of nitrogenous compounds is typically very low and an increase in the extraction temperature has very little effect on the level of TSNAs released during the extraction process. On the other hand, Burley tobacco typically has a much higher content of nitrogenous compounds and the amount of TSNAs released upon heating is found to vary significantly depending on the extraction temperature, with a direct correlation between the extraction temperature and the levels of TSNAs released.

It has also been found by the inventors of the present invention that for certain tobacco types, the level of a particular undesirable furan, 2-furanmethanol, released during extraction is dependent upon the extraction temperature. For Burley tobaccos, the reducing sugar content is typically very low (below 2% by weight) and an increase in the extraction temperature has very little effect on the level of 2-furanmethanol released during the extraction process. On the other hand, Bright tobaccos typically have a much higher reducing sugar content (up to 25% by weight) and the amount of 2-furanmethanol released upon heating is found to vary significantly depending on the extraction temperature, with a direct correlation between the extraction temperature and the level of 2-furanmethanol released. The degree of increase in the level of 2-furanmethanol released from the bright tobacco with increasing extraction temperature may be different for each tobacco type.

As described herein, during the heating step in the extraction process, the tobacco starting material is heated to an extraction temperature of between about 100 degrees Celsius and 160 degrees Celsius. It has been found that if the tobacco starting material is heated to a temperature above this range, in the resultant compositions the weight of phenol relative to the weight of β-ionone and β-damascenone is much higher, resulting in a ratio by weight of β-ionone and β-damascenone to phenol that is lower.

4-(methylnitrosamino)-1-(3-pyridyl)-1-butanone (NNK), (R,S)—N-nitrosoanatabine (NAT), (R,S)—N-nitrosoanabasine (NAB) and N-nitrosonornicotine (NNN) are TSNAs. As described herein, such undesirable compounds are derived in relatively higher amounts from tobaccos that are higher in nitrogenous compounds, such as Burley tobacco, and the amount of TSNAs released upon heating is found to vary significantly depending on the extraction temperature, with a direct correlation between the extraction temperature and the levels of TSNAs released.

As described herein, 2-furanemethanol is derived in relatively higher amounts from tobaccos that are higher in reducing sugar content, such as Bright tobacco, and the amount of 2-furanmethanol released upon heating is found to vary significantly depending on the extraction temperature, with a direct correlation between the extraction temperature and the level of 2-furanmethanol released.

As described herein, during the heating step in the extraction process, the tobacco starting material is heated to an extraction temperature of between about 100 degrees Celsius and 160 degrees Celsius. It has been found that if the tobacco starting material is heated to a temperature above this range, in the resultant compositions the weight of TSNAs and 2-furanemethanol relative to the weight of β-ionone and β-damascenone is much higher, resulting in a ratio by weight of (β-ionone+β-damascenone) to (4-(methylnitrosamino)-1-(3-pyridyl)-1-butanone+(R,S)—N-nitrosoanatabine+(R,S)—N-nitrosoanabasine (NAB) and N-nitrosonornicotine (NNN)+(2-furanemethanol/600) that is lower.

Nicotine is typically present in a higher percentage by weight in extracts produced from Burley tobacco relative to bright tobacco, but certain undesirable nitrogenous compounds such as TSNAs are typically derived in higher amounts from Burley tobacco relative to bright tobaccos. Certain desirable flavourant compounds such as furaneol are derived from reducing sugars and are typically present in a higher amounts in bright tobaccos relative to Burley tobaccos due to the higher reducing sugar of the former, but certain undesirable compounds such as 2-furanemethanol are also derived from reducing sugars and are typically present in higher amounts in bright tobaccos relative to Burley tobaccos. Therefore, the liquid tobacco extract of the present invention is preferably produced from a blend of different tobacco types. Preferably, the liquid tobacco extract is derived from Burley tobacco and bright tobacco. The bright tobacco may be one or more of Oriental tobacco and flue-cured tobacco.

During the heating step, the tobacco starting material is heated to an extraction temperature of between about 100 degrees Celsius and about 160 degrees Celsius. It has been found that below this range, insufficient levels of nicotine and certain flavour compounds are released from the tobacco starting material such that the resultant liquid tobacco extract lacks the desired flavour characteristics. On the other hand, if the tobacco starting material is heated to a temperature above this defined range, unacceptably high levels of certain undesirable tobacco compounds, such as phenol, TSNAs and 2-furanemethanol, may be released.

Preferably, the extraction temperature is at least about 110 degrees Celsius, more preferably at least about 115 degrees Celsius, more preferably at least about 120 degrees Celsius, more preferably at least about 125 degrees Celsius.

Preferably, the extraction temperature is no more than about 150 degrees Celsius, more preferably no more than about 145 degrees Celsius, more preferably no more than about 140 degrees Celsius, most preferably no more than about 135 degrees Celsius.

For example, the extraction temperature may be between about 110 degrees Celsius and 150 degrees Celsius, or between about 120 degrees Celsius and about 140 degrees Celsius, or between about 125 degrees Celsius and about 135 degrees Celsius, or about 130 degrees Celsius. An extraction temperature of around 130 degrees Celsius has been found to provide a particularly optimised ratio of desirable to undesirable compounds in the liquid tobacco extract. The tobacco starting material is heated at the extraction temperature for at least about 30 minutes or for at least about 60 minutes or for at least about 90 minutes, more preferably for at least about 120 minutes. This extraction time is sufficiently long that the desired tobacco flavour compounds can be extracted efficiently to provide a liquid tobacco extract that may be formed into a nicotine composition that can produce an aerosol having the desired flavour characteristics. Preferably, the tobacco starting material is heated at the extraction temperature for no more than about 270 minutes, more preferably no more than about 180 minutes.

For example, the tobacco starting material may be heated for between about 90 minutes and about 270 minutes, or between about 120 minutes and about 180 minutes.

The heating time indicated above corresponds to the duration of time over which the tobacco starting material is heated at the extraction temperature and does not include the time taken to increase the temperature of the tobacco starting material up to the extraction temperature.

In general, upon heating the natural tobacco material, any moisture present in the natural tobacco material is also released with the volatile species in the form of steam.

The heating step is preferably carried out in an inert atmosphere. For example, the natural tobacco material may be heated in a flow of inert gas or in a flow of a combination of an inert gas with water or steam. Preferably, a flow of an inert gas, such as nitrogen, is passed through the starting tobacco material during the heating step. As an alternative, the heating step may be carried out under vacuum.

The inventors have found that it is advantageous to heat the natural tobacco material in an inert atmosphere, since the volatile tobacco compounds are released into the flow of inert gas during the heating step such that the inert gas acts as a carrier for the volatile components.

The flow of inert gas helps convey the steam generated by evaporation of the moisture content of the natural tobacco material and the volatile species—including, in particular, nicotine or flavour-associated compounds or both—out of the extraction equipment.

Further, use of a flow of inert gas, such as nitrogen, under light over-pressure in the extraction equipment has the benefit of preventing the presence of oxygen within the extraction equipment. This can also be achieved by performing the heating step under vacuum. Such benefit is desirable in that it prevents risk of any, even partial, combustion of the natural tobacco material during the heating step. Uncontrolled combustion of the natural tobacco material would clearly be undesirable as it would represent a major safety risk within the manufacturing environment. However, the inventors have found that even a limited, partial combustion of the natural tobacco material may lead to a decrease in the quality of the tobacco extract obtainable by the method, which would be undesirable.

Without wishing to be bound by theory, it is understood that, by preventing combustion of the natural tobacco material, the formation of any undesirable combustion by-products is also prevented. Further, as conditions that would be conducive to combustion of the natural tobacco material are prevented, the natural tobacco material is effectively heated under conditions that mimic, to an extent, conditions under which a tobacco-containing substrate (e.g. homogenised tobacco material) is typically heated in "heat-not-burn" articles. As a result, selective extraction of the flavour-bearing volatile species responsible for the taste consumers associate with heated tobacco is advantageously favoured.

Therefore, by carrying out the second, heating step in an inert atmosphere the extraction efficiency, product quality and manufacturing safety are advantageously enhanced.

The inert gas flow rate may be optimised based on the scale and geometry of the extraction chamber. A relatively high flow rate of inert gas may advantageously further improve the efficiency of extraction from the tobacco starting material.

The addition of water or steam to the tobacco during extraction has been found to increase yield of extracted components. However, excess addition of water or steam leads to processing difficulties such as stickiness of the tobacco material. Suitable heating methods for carrying out the heating of the tobacco starting material would be known to the skilled person and include but are not limited to: dry distillation, hydrodistillation, vacuum distillation, flash distillation and thin film hydrodistillation.

Optionally, the tobacco starting material may be digested enzymatically prior to the heating step. This has been found to provide a significant increase in the yield of certain flavour compounds from the tobacco starting material.

The tobacco starting material may optionally be analysed prior to the heating step in order to determine the composition, for example, the content of reducing sugars of alkaloids. This information about the composition may helpfully be used to select an appropriate extraction temperature.

During the heating of the tobacco starting material, the volatile compounds released from the tobacco starting material are collected using any suitable technique. Where the tobacco starting material is heated in a flow of an inert gas, as described above, the volatile compounds are collected from the inert gas flow. Different collection methods would be well known to the skilled person.

Preferably, the step of collecting the volatile compounds uses an absorption technique in which the volatile compounds are trapped in a non-aqueous solvent. For example, an inert gas flow containing the volatile compounds may be directed into a container of a non-aqueous extraction solvent. The non-aqueous extraction solvent is preferably an aerosol former. The non-aqueous solvent is preferably triacetin, glycerine, propylene glycol (PG), 1,3-propanediol or a mixture thereof. The non-aqueous extraction solvent may be a polyhydric alcohol. The use of an aerosol former as the non-aqueous extraction solvent is potentially beneficial because the aerosol former can be retained as a diluting agent in the final liquid tobacco extract and nicotine composition. This means that an additional step of removing the non-aqueous extraction solvent is not necessarily required.

In preferred embodiments, the volatile compounds are collected by condensation, and the condensate obtained is added to a liquid aerosol former, preferably PG.

The addition of a liquid aerosol former, and particularly addition of PG, may advantageously prevent the condensed volatile compounds from splitting into two phases or forming an emulsion, as some tobacco constituents would tend to do. Without wishing to be bound by theory, the inventors have observed that the solubility of the tobacco constituents in the hydrolate (i.e. the aqueous fraction of the liquid, naturally derived tobacco extract) depends primarily on their polarity, on their concentration and on the pH of the hydrolate, which may vary depending on the tobacco type. As a result, an oily layer tends to form at the surface of the liquid, naturally derived tobacco extract, if the amount of aerosol former is not sufficient. Such oily material can aggregate at different locations on the trapping equipment wherein the collecting step is carried out. The addition of a liquid aerosol former, such as PG, helps prevent the formation of such layer and favours homogenisation of the liquid, naturally derived tobacco extract. This, in turn, helps prevent any loss of desirable flavour-associated compounds during the fourth (desiccation) step, during which such compounds may undesirably deposit on the equipment surfaces.

In addition, the liquid aerosol former advantageously helps trap the flavour-associated compounds independent of their polarity and volatility. Further, during the fourth (desiccation) step, the liquid aerosol former helps prevent loss of the most volatile fraction, as well as favour the selective removal of excess water from the liquid, naturally derived tobacco extract to obtain the concentrated tobacco extract.

Use of PG as the aerosol former for the condensation and collection step has the further advantage that, by reducing the water activity of aqueous solutions, PG exerts an anti-microbial activity. By adjusting the content of PG in the liquid, naturally derived tobacco extract, it is therefore also possible to ensure that the extract substantially does not undergo any microbial activity.

The liquid, naturally derived tobacco extract obtained at the end of the collecting step is typically a homogenous liquid. Such homogenous liquid may be stored for a limited period of hold-time (up to about 4 weeks) prior to undergoing an option desiccation step. The composition of the liquid, naturally derived tobacco extract depends on a number of variables, including the nature of the natural tobacco material; the moisture content in the natural tobacco material; the amount of aerosol former used to prepare the natural tobacco material, if any.

Preferably, the non-aqueous extraction solvent is retained at a temperature of less than 0 degrees Celsius in order to optimise the transfer of the volatile compounds into the non-aqueous extraction solvent. The non-aqueous extraction solvent is preferably retained at a temperature of no less than −10 degrees Celsius. Temperatures below such value may lead to undesirable freezing phenomena.

As an alternative to an absorption technique, the step of collecting the volatile compounds may be carried out using a condensation technique in which the volatile compounds are condensed and the condensate is collected. Condensation of the volatile compounds may be carried out using any suitable apparatus, for example, in a refrigerated column. Where the volatile compounds are collected by condensation, the step of forming the liquid tobacco extract may comprise adding the condensate to a non-aqueous extraction solvent, such as an aerosol former.

As a further alternative, the step of collecting the volatile compounds may be carried out using an adsorption technique in which the volatile compounds are adsorbed onto the surface of a solid adsorbent material, such as activated carbon. The adsorbed compounds are then transferred into a non-aqueous extraction solvent.

Optionally, the step of forming the liquid tobacco extract comprises a filtering step.

Optionally, the step of forming the liquid tobacco extract comprises a blending step in which extracts derived from different tobacco starting materials are combined.

In the method, the next step is the formation of a liquid tobacco extract from the collected volatile compounds. The nature of this step may depend upon the collection method. The "collected volatile compounds" will typically comprise a solution of the tobacco derived volatile compounds in a non-aqueous extraction solvent.

The extraction method provides a liquid tobacco extract that comprises greater than about 20 percent by weight of water based on the weight of the liquid tobacco extract. Generally, the liquid tobacco extract may comprise at least about 40 percent by weight of water. The liquid tobacco extract may comprise between about 40 percent by weight and about 70 percent by weight water.

The extraction method described herein provides a liquid tobacco extract with a nicotine content of at least 0.2 percent by weight. More preferably, the nicotine content in the liquid tobacco extract is at least about 0.4 percent by weight. The liquid tobacco extract may have a nicotine content of no more than about 10 percent by weight, more preferably no more than about 8 percent by weight, more preferably no more than about 5 percent by weight, most preferably no more than about 3.6 percent by weight. Most preferably, the liquid tobacco extract comprises between about 0.4 percent by weight and 3.6 percent by weight nicotine, based on the weight of the liquid tobacco extract.

The extraction method described herein provides a liquid tobacco extract that may have a non-aqueous extraction solvent content of from about 25 percent to about 65 percent by weight, preferably from about 30 percent to 60 percent by weight, most preferably from about 35 percent to about 55 percent by weight. The non-aqueous extraction solvent is preferably triacetin, glycerine, propylene glycol, 1,3-propanediol or a mixture thereof.

A nicotine composition can advantageously be formed directly from the liquid tobacco extract resulting from the extraction process, without the need for addition of further nicotine. A nicotine composition can advantageously be formed directly from the liquid tobacco extract resulting from the extraction process, without the need for addition of further flavour compounds. A nicotine composition can advantageously be formed directly from the liquid tobacco extract without the need for addition of additional non-aqueous solvent. For example, the liquid tobacco extract produced by the extraction process may be used to make a nicotine composition comprising between 10 and 20 mg of nicotine per millilitre, without the need for addition of nicotine.

Alternatively, the liquid tobacco extract may be subjected to additional processing steps to form a nicotine composition. Even when subjected to such additional steps, a nicotine composition may be formed without the need for addition of further nicotine or flavour compounds. Preferably, the liquid tobacco extract may be concentrated in a desiccation step, such as a desiccation step described herein, to form a concentrated tobacco extract. The concentrated tobacco extract may be used to form the nicotine composition. Preferably, additional non-aqueous solvent may be added to the liquid tobacco extract or the concentrated tobacco extract to form a nicotine composition.

Where the volatile compounds are collected by absorption in a non-aqueous extraction solvent, as described above, the solution of the volatile compounds in a liquid solvent forming the liquid tobacco extract is preferably dried in order to concentrate the solution, as the liquid solvent may include both non-aqueous extraction solvent and water. This may be carried out, for example, in order to arrive at a desired concentration of nicotine, or flavour compounds. Drying may be carried out using any suitable means, including but not limited to desiccation, molecular sieves, freeze drying, phase separation, distillation, membrane permeation, controlled crystallisation of water and filtering, reverse hygroscopicity, ultracentrifugation, liquid chromatography, reverse osmosis or chemical drying.

The solution of the volatile compounds in a liquid solvent forming the liquid tobacco extract is preferably concentrated by desiccation in a desiccation step to form a concentrated tobacco extract. A concentrated tobacco extract may be used to form a nicotine composition.

In a desiccation step, the solution of the volatile compounds in a liquid solvent is heated to evaporate at least some of the water and obtain a concentrated tobacco extract. To this purpose, the solution of the volatile compounds in a liquid solvent may be heated to a temperature and for a time such that the water content in the tobacco extract is reduced by at least about 60 percent.

In an embodiment, the solution of the volatile compounds in a liquid solvent is heated under vacuum, preferably at a temperature of at least about 70 degrees Celsius. In another embodiment, the solution of the volatile compounds in a liquid solvent is heated under a flow of air, preferably under a flow of air having relatively low humidity, at a temperature of at least about 35 degrees Celsius. Thus, a concentrated tobacco extract may be obtained. One such concentrated tobacco extract typically contains less than about 20 percent by weight of water.

In a desiccation step, the liquid tobacco extract may be heated from about 35 degrees Celsius to about 95 degrees Celsius, more preferably from about 35 degrees Celsius to about 90 degrees Celsius, even more preferably from about 35 degrees Celsius to about 85 degrees Celsius, most preferably from about 35 degrees Celsius to about 80 degrees Celsius.

In a desiccation step, the liquid tobacco extract may be heated at a reduced pressure. The liquid tobacco extract may be heated at a pressure of less than or equal to about 200 mbar. In a desiccation step, the liquid tobacco extract may be heated at a pressure of at least about 20 mbar.

Alternatively, in a desiccation step, the liquid tobacco extract may be heated under a flow of air. The liquid tobacco extract may be heated under a flow of air of at least about 10 kg/h. The liquid tobacco extract may be heated under a flow of air of at least about 15 kg/h. The relative humidity of the flow of air may be less than or equal to about 50 percent, preferably less than or equal to about 25 percent.

Following a desiccation step, the liquid tobacco extract is referred to as a concentrated tobacco extract. The concentrated tobacco extract comprises less than or equal to about 20 percent by weight of water. Preferably, the concentrated tobacco extract comprises between 8 percent and 15 percent by weight water based on the weight of the concentrated tobacco extract.

The desiccation step provides a concentrated tobacco extract that may have a non-aqueous extraction solvent content of from about 65 percent to about 95 percent by weight, preferably from about 65 percent to 85 percent by weight, most preferably from about 75 percent to about 85 percent by weight. The non-aqueous extraction solvent is preferably triacetin, glycerine, propylene glycol, 1,3-propanediol or a mixture thereof.

The desiccation step provides a concentrated tobacco extract that may have a nicotine content of at least about 0.2 percent by weight nicotine, preferably from about 0.5 percent by weight to about 12 percent by weight nicotine, most preferably from about 2 percent by weight to about 8 percent by weight nicotine.

The concentrated tobacco extract may be used directly to form a nicotine composition, without the need for addition of additional nicotine. The concentrated tobacco extract may be used directly to form a nicotine composition, without the need for addition of additional non-aqueous solvent. The concentrated tobacco extract may be used directly to form a nicotine composition, without the need for addition of additional water. The concentrated tobacco extract may be used directly to form a nicotine composition, without the need for addition of additional flavourants.

Preferably, additional non-aqueous solvent may be added to the liquid tobacco extract or the concentrated tobacco extract to form the nicotine composition.

The liquid tobacco extract, concentrated tobacco extract and nicotine composition may possess optional and preferred features as described previously herein.

The invention will now be further described with reference to the following examples.

EXAMPLES

Example 1

A tobacco starting material is prepared from a flue-cured Bright tobacco material. The tobacco material is cut to form tobacco shreds having dimensions of 2.5 millimetres by 2.5 millimetres and the tobacco shreds are loaded into an extraction chamber, without compression. The tobacco starting material is heated within the extraction chamber to a temperature of 130 degrees Celsius for a period of 3 hours. During heating, a flow of nitrogen is passed through the extraction chamber at a flow rate of about 40 litres per minute.

The volatile compounds released from the tobacco starting material during the heating step are collected by absorption into a liquid solvent formed of propylene glycol at minus 10 degrees Celsius and with agitation of 750 rpm.

A liquid tobacco extract is obtained directly from an extraction process at a temperature of 130 degrees Celsius for a period of 3 hours. The liquid tobacco extract provides an optimised level of desirable flavour compounds such as β-damascenone and β-ionone to undesirable compounds such as phenol, 4-(methylnitrosamino)-1-(3-pyridyl)-1-butanone, (R,S)—N-nitrosoanatabine, (R,S)—N-nitrosoanabasine, N-nitrosonornicotine and 2-furanemethanol. In particular, the liquid tobacco extract contains more than 0.2 percent by weight of nicotine based on the weight of the liquid tobacco extract. Further, in the liquid tobacco extract a ratio by weight of (β-ionone+β-damascenone) to (phenol) is greater than 0.25.

Example 2

This example provides two concentrated tobacco extracts obtained from separate extraction processes at a temperature of 130 degrees Celsius for a period of 3 hours, each process followed by a desiccation step to reduce the moisture level of the liquid tobacco extract to approximately 6 percent. Both liquid tobacco extracts contain more than 0.2 percent by weight of nicotine based on the weight of the liquid tobacco extract. Further, in both liquid tobacco extracts a ratio by weight of (β-ionone+β-damascenone) to (phenol) is greater than 0.25.

Example 2a

Example 2a relates to a concentrated tobacco extract derived from flue-cured Bright tobacco material. The content of the liquid tobacco extract of Example 2a is as follows:

Nicotine: 0.53% w/w
Propylene Glycol: 91.8% w/w
Water: 6.3% w/w
Balance (including flavourants as detailed in Table 1 below): 1.57% w/w

Example 2b

Example 2b relates to a concentrated tobacco extract derived from Burley tobacco material. The content of the liquid tobacco extract of Example 2b is as follows:

Nicotine: 1.82% w/w
Propylene Glycol: 89.6% w/w
Water: 5.7% w/w
Balance (including flavourants as detailed in Table 1 below): 2.88% w/w

TABLE 1

Content of selected flavour compounds in concentrated tobacco extract (all values given in micrograms per kilogram of liquid tobacco extract)

| Example | Acetic acid | β-ionone | β-damascenone | furaneol | 2,3-diethyl-5-methylprazine | Vanillin | 2-ethyl-3,5-dimethylpyrazine | 2-methylbutanoic acid |
|---|---|---|---|---|---|---|---|---|
| 2a | 6193580 | 1352 | 2995 | 2420 | 39 | 1040 | 838 | 14081 |
| 2b | 3868247 | 939 | 1139 | 154 | 478 | 340 | 1980 | 16209 |

| Example | 3-methylbutanoic acid | 3-methyl-2,4-nonanedione | 2-methoxyphenol | 2-phenylethanol | Eugenol | sotolone |
|---|---|---|---|---|---|---|
| 2a | 20114 | 273 | 1649 | 19875 | 619 | 85 |
| 2b | 36356 | 69 | 3169 | 18196 | 845 | 36 |

Examples 2a and 2b in accordance with the invention contain acceptably low levels of undesirable compounds such as phenol, 4-(methylnitrosamino)-1-(3-pyridyl)-1-butanone, (R,S)—N-nitrosoanatabine, (R,S)—N-nitrosoanabasine, N-nitrosonornicotine and 2-furanemethanol.

Example 3

This example provides three concentrated tobacco extracts obtained from separate extraction processes at a temperature of 130 degrees Celsius for a period of 3 hours, each followed by a dessication step to reduce the moisture level of the liquid tobacco extract to approximately 12.5 percent. All these liquid tobacco extracts contain more than 0.2 percent by weight of nicotine based on the weight of the liquid tobacco extract. Further, in these liquid tobacco extracts a ratio by weight of (β-ionone+β-damascenone) to (phenol) is greater than 0.25.

Example 3a

Example 3a relates to a concentrated tobacco extract derived from oriental Bright tobacco material. The content of the concentrated tobacco extract of Example 3a is as follows:

Nicotine: 0.4% w/w
Propylene glycol: 84% w/w
Acetic Acid: 1.0% w/w
Water: 12.5% w/w
Balance (including flavourants): 2.1% w/w

Example 3b

Example 3b relates to a concentrated tobacco extract derived from flue-cured Bright tobacco material. The content of the concentrated tobacco extract of Example 3b is as follows:

Nicotine: 1.2% w/w
Propylene Glycol: 84% w/w
Acetic acid: 1.0% w/w
Water: 12.5% w/w
Balance (including flavourants): 1.3% w/w

Example 3c

Example 3c relates to a concentrated tobacco extract derived from Burley tobacco material. The content of the concentrated tobacco extract of Example 3c is as follows:

Nicotine: 2.6% w/w
Propylene Glycol: 84% w/w
Acetic acid: 0.5% w/w
Water: 12.5% w/w
Balance (including flavourants): 0.4% w/w The concentrated tobacco extracts of Example 3 provide an optimised level of desirable flavour compounds such as β-damascenone and β-ionone to undesirable compounds such as phenol, 4-(methylnitrosamino)-1-(3-pyridyl)-1-butanone, (R,S)—N-nitrosoanatabine, (R,S)—N-nitrosoanabasine, N-nitrosonornicotine and 2-furanemethanol.

Example 4

The liquid tobacco extract of Example 1 was concentrated in a desiccation process to reduce the moisture level of the liquid tobacco extract to approximately 15 percent.

Glycerine was added to the resultant concentrated tobacco extract to form the nicotine composition, such that the nicotine composition contained 20 percent by weight glycerine and 80 percent by weight liquid tobacco extract, based on the weight of the nicotine composition.

Example 5

Example 5 relates to a nicotine composition in the form of a gel. The gel nicotine composition is formed from the liquid tobacco extract of Example 1. The content of the gel nicotine composition is as follows:

Liquid tobacco extract of Example 1: 99.0% w/w
Agar: 1.0% w/w

Example 6

Three tobacco starting materials in accordance with the present invention are prepared from a flue-cured Bright tobacco material (6A), a Burley tobacco material (6B), and an Oriental tobacco material (6C), respectively.

Each one of the three tobacco materials is cut to form tobacco shreds having dimensions of 2.5 millimetres by 2.5 millimetres, and the tobacco shreds are loaded into an extraction chamber, without compression.

Each one of the tobacco starting materials is heated within the extraction chamber to a temperature of 130 degrees Celsius for a period of 120 minutes. During heating, a flow of nitrogen is passed through the extraction chamber at a flow rate of 2 litres per minute.

The volatile compounds released from each tobacco starting material during the heating step are collected by absorption into a liquid solvent formed of polypropylene glycol at 0 degrees Celsius.

A liquid tobacco extract is obtained directly from such extraction process. Each liquid extract obtained from each one of the three tobacco starting materials is then concentrated under vacuum (50 mbar) at 55 degrees Celsius until a moisture content of 12 percent±2 percent is reached.

TABLE 2

Value of selected ratios by weight of desirable to undesirable tobacco compounds within the liquid tobacco extracts

| Example | (β-ionone + β-damascenone) to (phenol) | (furaneol + (2,3-diethyl-5-methylpyrazine)* 100)) to (nicotine) | (β-ionone + β-damascenone) to (4-(methylnitrosamino)-1-(3-pyridyl)-1-butanone + (R,S)-N-nitrosoanatabine + (R,S)-N-nitrosoanabasine + N-nitrosonornicotine + ((2-furanemethanol)/600)) |
|---|---|---|---|
| 6A | 2.27 | $1.35 \times 10^{-3}$ | 5.25 |
| 6B | 2.96 | $1.71 \times 10^{-3}$ | 3.50 |
| 6C | 4.12 | $2.75 \times 10^{-3}$ | 7.83 |

In all three liquid extracts in accordance with the invention 6A, 6B, and 6C the ratio by weight of (β-ionone+β-damascenone) to (phenol) is consistently and significantly above 2.0. Further, in all three liquid extracts in accordance with the invention 6A, 6B, and 6C the ratio by weight of (furaneol+(2,3-diethyl-5-methylpyrazine)*100)) to (nicotine) is consistently and significantly above $1\times10^{-3}$. Additionally, in all three liquid extracts in accordance with the invention 6A, 6B, and 6C the ratio by weight of (β-ionone+β-damascenone) to (4-(methylnitrosamino)-1-(3-pyridyl)-1-butanone+(R,S)—N-nitrosoanatabine+(R,S)—N-nitrosoanabasine+N-nitrosonornicotine+((2-furanemethanol)/600)) is consistently and significantly above 3.

Comparative Example

Two tobacco starting materials are prepared from a flue-cured Bright tobacco material (CE1, CE2). Two further tobacco starting materials are prepared from a Burley tobacco material (CE3, CE4). Each one of the four starting tobacco materials is cut to form tobacco shreds having dimensions of 2.5 millimetres by 2.5 millimetres.

The tobacco shreds are mixed with an alkaline solution of potassium carbonate in water to achieve a predetermined pH for each tobacco material. One such alkali treatment of a starting tobacco material is described in US 2016/360780.

In more detail, tobacco starting materials CE1 and CE3 are mixed with an alkaline solution of potassium carbonate in water to achieve a pH of 8, whereas tobacco starting materials CE2 and C4 are mixed with an alkaline solution of potassium carbonate in water to achieve a pH of 9.5.

Following such alkali treatment, the tobacco shreds of each tobacco starting material are loaded into an extraction chamber, without compression. Each tobacco starting material is heated within the extraction chamber to a temperature of 130 degrees Celsius for a period of 120 minutes. During heating, a flow of nitrogen is passed through the extraction chamber at a flow rate of about 2 litres per minute.

The volatile compounds released from each tobacco starting material during the heating step are collected by absorption into a liquid solvent formed of polypropylene glycol at 0 degrees Celsius.

A liquid tobacco extract is obtained directly from such extraction process. Each liquid extract obtained from each one of the four tobacco starting materials is then concentrated under vacuum (50 mbar) at 55 degrees Celsius until a moisture content of 12 percent±2 percent is reached.

TABLE 3

Value of selected ratios by weight of desirable to undesirable tobacco compounds within the liquid tobacco extracts

| Example | (β-ionone + β-damascenone) to (phenol) | (furaneol + (2,3-diethyl-5-methylpyrazine)* 100)) to (nicotine) | (β-ionone + β-damascenone) to (4-(methylnitrosamino)-1-(3-pyridyl)-1-butanone + (R,S)-N-nitrosoanatabine + (R,S)-N-nitrosoanabasine + N-nitrosonornicotine + ((2-furanemethanol)/600)) |
|---|---|---|---|
| CE1 | 0.10 | $4.53 \times 10^{-4}$ | 0.32 |
| CE2 | 0.14 | $2.98 \times 10^{-4}$ | 2.25 |
| CE3 | 0.12 | $1.17 \times 10^{-4}$ | 0.39 |
| CE4 | 0.10 | $4.30 \times 10^{-4}$ | 0.35 |

In all four liquid extracts in accordance with the Comparative Example CE1, CE2, CE3 and CE4 the ratio by weight of (β-ionone+β-damascenone) to (phenol) is consistently and significantly below 0.25. Further, in all four liquid extracts in accordance with the Comparative Example CE1, CE2, CE3 and CE4 the ratio by weight of (furaneol+(2,3-diethyl-5-methylpyrazine)*100)) to (nicotine) is consistently and significantly below $5\times10^{-4}$.

The invention claimed is:

1. A liquid tobacco extract, comprising:

tobacco volatiles removed from a natural tobacco material with heating in an inert gas stream and collected from the inert gas stream away from the natural tobacco material; and a non-aqueous solvent, wherein the natural tobacco material is not subjected to any treatment adapted to alter the pH of the natural tobacco, the liquid tobacco extract is a homogeneous liquid, the tobacco volatiles collected from the inert gas stream comprises β-ionone, β-damascenone and phenol, a content of nicotine collected from the tobacco volatiles is at least 0.2 percent by weight of the liquid tobacco extract, and a ratio by weight of the collected volatiles (β-ionone+β-damascenone) to collected volatile phenol in the liquid tobacco extract is greater than 0.25.

2. The liquid tobacco extract according to claim 1, further comprising water, wherein the liquid tobacco extract comprises greater than 20 percent by weight of water based on the weight of the liquid tobacco extract.

3. The liquid tobacco extract according to claim 2, wherein the liquid tobacco extract comprises at least about 40 percent by weight of water based on the weight of the liquid tobacco extract.

4. The liquid tobacco extract according to claim 2, wherein the liquid tobacco extract comprises between 40 percent by weight and 70 percent by weight water based on the weight of the liquid tobacco extract.

5. The liquid tobacco extract according to claim 1, further comprising water, wherein the liquid tobacco extract is a concentrated tobacco extract comprising less than or equal to about 20 percent by weight of water based on the weight of the concentrated tobacco extract.

6. The liquid tobacco extract according to claim 1, further comprising water, wherein the liquid tobacco extract is a concentrated tobacco extract comprising between 8 percent and 15 percent by weight water based on the weight of the concentrated tobacco extract.

7. The liquid tobacco extract according to claim 1, wherein the ratio by weight of collected volatiles (β-ionone+β-damascenone) to collected volatile phenol is greater than 0.5.

8. The liquid tobacco extract according to claim 1, wherein the ratio by weight of collected volatiles (β-ionone+β-damascenone) to collected volatile phenol is greater than 1.

9. The liquid tobacco extract according to claim 1, wherein the ratio by weight of collected volatiles (β-ionone+β-damascenone) to collected volatile phenol is greater than 2.

10. The liquid tobacco extract according to claim 1, wherein the liquid tobacco extract comprises between 0.4 percent by weight and 3.6 percent by weight nicotine based on the weight of the liquid tobacco extract.

11. The liquid tobacco extract according to claim 1, wherein the tobacco volatiles collected from the inert gas stream further comprises 4-(methylnitrosamino)-1-(3-pyridyl)-1-butanone, (R,S)-N-nitrosoanatabine, (R,S)-N-nitrosoanabasine, N-nitrosonornicotine, and 2-furanemethanol), and a ratio by weight of collected volatiles (β-ionone+β-damascenone) to collected volatiles (4-(methylnitrosamino)-1-(3-pyridyl)-1-butanone+(R,S)-N-nitrosoanatabine+(R,S)-N-nitrosoanabasine+N-nitrosonornicotine+((2-furanemethanol)/600)) is greater than 1.5.

12. The liquid tobacco extract according to claim 1, wherein the natural tobacco material comprises Burley tobacco and Bright tobacco.

13. The liquid tobacco extract according to claim 12, wherein the Bright tobacco is one or more of Oriental tobacco and flue-cured tobacco.

14. The liquid tobacco extract according to claim 1, wherein the non-aqueous solvent is glycerine, propylene glycol, triacetin, 1,3-propanediol, or a mixture thereof.

15. The liquid tobacco extract according to claim 1, wherein the tobacco volatiles collected from the inert gas stream further comprises one or more collected volatile selected from the group consisting of furaneol, 2,3-diethyl-5-methylpyrazine, acetic acid, vanillin, 2-ethyl-3,5-dimethylpyrazine, 2-methylbutanoic acid, 3-methylbutanoic acid, 3-methyl-2,4-nonanedione, 2-methoxyphenol, 2-phenylethanol, eugenol, and sotolone.

16. The liquid tobacco extract according to claim 15, wherein the liquid tobacco extract comprises at least 300 micrograms of acetic acid per gram of the liquid tobacco extract.

17. A cartridge, comprising:

a nicotine composition, wherein the nicotine composition comprises the liquid tobacco extract of claim 1.

18. A liquid tobacco extract, comprising a non-aqueous solvent, nicotine, and tobacco volatiles removed from a tobacco material with heating in an inert gas stream and collected from the inert gas stream away from the tobacco material, wherein a ratio by weight of (β-ionone+β-damascenone) in the collected tobacco volatiles to phenol in the collected tobacco volatiles is greater than 0.25, prepared by a method comprising:

heating a tobacco starting material at an extraction temperature of between 100 degrees Celsius and 160 degrees Celsius for at least 90 minutes in an inert gas stream;

collecting volatile compounds released from the tobacco starting material in the inert gas stream during the heating of the tobacco starting material; and obtaining the liquid tobacco extract comprising the collected volatile compounds as a homogeneous liquid.

19. The liquid tobacco extract of claim 18, wherein the liquid tobacco extract further comprises water, and the method further comprises desiccating the liquid tobacco extract to obtain a concentrated tobacco extract.

20. The liquid tobacco extract of claim 18, wherein the extraction temperature is between 125 degrees Celsius and 160 degrees Celsius.

21. The liquid tobacco extract of claim 18, wherein the extraction temperature is between 125 degrees Celsius and 140 degrees Celsius.

* * * * *